US008115419B2

(12) United States Patent
Given et al.

(10) Patent No.: US 8,115,419 B2
(45) Date of Patent: Feb. 14, 2012

(54) LIGHTING CONTROL DEVICE FOR CONTROLLING DIMMING, LIGHTING DEVICE INCLUDING A CONTROL DEVICE, AND METHOD OF CONTROLLING LIGHTING

(75) Inventors: Terry Given, Papakura (NZ); Michael Harris, Cary, NC (US); Peter Jay Myers, Raleigh, NC (US)

(73) Assignee: Cree, Inc., Durham, NC (US)

( * ) Notice: Subject to any disclaimer, the term of this patent is extended or adjusted under 35 U.S.C. 154(b) by 444 days.

(21) Appl. No.: 12/328,115

(22) Filed: Dec. 4, 2008

(65) Prior Publication Data

US 2009/0184662 A1 Jul. 23, 2009

Related U.S. Application Data

(60) Provisional application No. 61/022,886, filed on Jan. 23, 2008, provisional application No. 61/039,926, filed on Mar. 27, 2008.

(51) Int. Cl.
*H05B 37/02* (2006.01)

(52) U.S. Cl. ..... 315/307; 315/247; 315/224; 315/209 R

(58) Field of Classification Search ..... 315/209 R, 315/224–226, 247, 291, 297, 307, 360, DIG. 4
See application file for complete search history.

(56) References Cited

U.S. PATENT DOCUMENTS

| | | | |
|---|---|---|---|
| 3,755,697 | A | 8/1973 | Miller |
| 3,787,752 | A | 1/1974 | Delay |
| 4,090,189 | A | 5/1978 | Fisler |
| 4,717,868 | A | 1/1988 | Peterson |
| 5,128,595 | A | 7/1992 | Hara |
| 5,151,679 | A | 9/1992 | Dimmick |
| 5,175,528 | A | 12/1992 | Choi et al. |
| 5,345,167 | A | 9/1994 | Hasegawa et al. |
| 5,371,439 | A | 12/1994 | Griffin |

(Continued)

FOREIGN PATENT DOCUMENTS

| | | |
|---|---|---|
| EP | 1 128 711 | 8/2001 |

(Continued)

OTHER PUBLICATIONS

Craig DiLouie, *Dimming HID lamps can produce significant energy savings and increase user flexibility*, HID Lamp Dimming, Oct. 1, 2004, 6 pages.

(Continued)

*Primary Examiner* — Shawki S Ismail
*Assistant Examiner* — Jany Tran
(74) *Attorney, Agent, or Firm* — Burr & Brown

(57) ABSTRACT

A lighting control circuit comprises a dimming level detection circuit, a waveform generator and a comparator circuit. The dimming level detection circuit is configurable to generate a first voltage level signal corresponding to a selected one of at least two different types of dimming signals selected from among an AC phase cut dimming signal, a DC voltage level dimming signal or a PWM dimming signal. The waveform generator is configured to output a periodic waveform. The comparator circuit is configured to compare the periodic waveform with the first voltage level signal to generate an output waveform having a duty cycle corresponding to a dimming level of the one of the at least two different input dimming signals and a frequency corresponding to the frequency of the periodic waveform. Also, methods of controlling lighting.

30 Claims, 13 Drawing Sheets

U.S. PATENT DOCUMENTS

| | | | |
|---|---|---|---|
| 5,661,645 | A | 8/1997 | Hochstein |
| 5,736,881 | A | 4/1998 | Ortiz |
| 5,783,909 | A | 7/1998 | Hochstein |
| 5,844,377 | A | 12/1998 | Anderson et al. |
| 5,912,568 | A | 6/1999 | Kiley |
| 5,959,316 | A | 9/1999 | Lowery |
| 6,051,935 | A | 4/2000 | Bucks et al. |
| 6,150,771 | A | 11/2000 | Perry |
| 6,161,910 | A | 12/2000 | Reisenauer et al. |
| 6,222,172 | B1 | 4/2001 | Fossum et al. |
| 6,236,331 | B1 | 5/2001 | Dussureault |
| 6,285,139 | B1 | 9/2001 | Ghanem |
| 6,329,760 | B1 | 12/2001 | Bebenroth |
| 6,329,764 | B1 | 12/2001 | Van de Ven |
| 6,340,868 | B1 | 1/2002 | Lys et al. |
| 6,350,041 | B1 | 2/2002 | Tarsa et al. |
| 6,362,578 | B1 | 3/2002 | Swanson et al. |
| 6,388,393 | B1 | 5/2002 | Illingworth |
| 6,400,101 | B1 | 6/2002 | Biebl et al. |
| 6,486,616 | B1 | 11/2002 | Liu et al. |
| 6,528,954 | B1 | 3/2003 | Lys et al. |
| 6,576,930 | B2 | 6/2003 | Reeh et al. |
| 6,577,072 | B2 | 6/2003 | Saito et al. |
| 6,586,890 | B2 | 7/2003 | Min et al. |
| 6,614,358 | B1 | 9/2003 | Hutchison et al. |
| 6,616,291 | B1 | 9/2003 | Love |
| 6,630,801 | B2 | 10/2003 | Schuurmans |
| 6,636,003 | B2 | 10/2003 | Rahm et al. |
| 6,724,376 | B2 | 4/2004 | Sakura et al. |
| 6,747,420 | B2 | 6/2004 | Barth et al. |
| 6,808,287 | B2 | 10/2004 | Lebens et al. |
| 6,809,347 | B2 | 10/2004 | Tasch et al. |
| 6,836,081 | B2 | 12/2004 | Swanson et al. |
| 6,841,804 | B1 | 1/2005 | Chen et al. |
| 6,841,947 | B2 | 1/2005 | Berg-johansen |
| 6,858,994 | B2 | 2/2005 | Vollrath |
| 6,873,203 | B1 | 3/2005 | Latham, II et al. |
| 6,936,857 | B2 | 8/2005 | Doxsee et al. |
| 6,987,787 | B1 | 1/2006 | Mick |
| 6,995,518 | B2 | 2/2006 | Havlik et al. |
| 7,038,399 | B2 | 5/2006 | Lys et al. |
| 7,071,762 | B2 | 7/2006 | Xu et al. |
| 7,119,498 | B2 | 10/2006 | Baldwin et al. |
| 7,180,487 | B2 | 2/2007 | Kamikawa et al. |
| 7,202,608 | B2 | 4/2007 | Robinson et al. |
| 2001/0024112 | A1 | 9/2001 | Jacobs et al. |
| 2002/0063534 | A1* | 5/2002 | Min ..... 315/169.3 |
| 2002/0145886 | A1 | 10/2002 | Stevens |
| 2003/0146715 | A1 | 8/2003 | Suomi |
| 2005/0122057 | A1 | 6/2005 | Chen et al. |
| 2006/0105482 | A1 | 5/2006 | Alferink |
| 2007/0182347 | A1 | 8/2007 | Shteynberg et al. |
| 2007/0205728 | A1* | 9/2007 | Suzuki et al. ..... 315/291 |
| 2007/0247414 | A1 | 10/2007 | Roberts |
| 2008/0048582 | A1 | 2/2008 | Robinson |
| 2008/0088248 | A1 | 4/2008 | Myers |
| 2009/0184666 | A1 | 7/2009 | Myers |
| 2010/0301751 | A1* | 12/2010 | Chobot et al. ..... 315/86 |

FOREIGN PATENT DOCUMENTS

| | | |
|---|---|---|
| EP | 1 538 882 | 6/2005 |
| JP | 2006-242733 | 9/1994 |

OTHER PUBLICATIONS

Zhu et al., "Optimizing the Performance of Remote Phosphor LED" First International Conference on White LEDs and Solid State Lighting.

* cited by examiner

LIGHTING CONTROL DEVICE FOR CONTROLLING DIMMING, LIGHTING DEVICE INCLUDING A CONTROL DEVICE, AND METHOD OF CONTROLLING LIGHTING

CLAIM OF PRIORITY

The present Application claims priority from U.S. Provisional Patent Application Ser. No. 61/022,886 entitled "FREQUENCY CONVERTED DIMING SIGNAL GENERATION," filed Jan. 23, 2008 and U.S. Provisional Patent Application Ser. No. 61/039,926 entitled "FREQUENCY CONVERTED DIMMING SIGNAL GENERATION," filed Mar. 27, 2008, the disclosures of which are incorporated herein as if set forth in their entirety.

RELATED APPLICATIONS

The present application is related to U.S. patent application Ser. No. 12/328,144 (now U.S. Patent Publication No. 2009/0184666), entitled "Frequency Converted Dimming Signal Generation" filed Dec. 4, 2008, the disclosure of which is incorporated herein as if set forth in its entirety.

FIELD OF THE INVENTION(S)

The present inventive subject matter relates to lighting devices and more particularly to power control for light emitting devices in the presence of a dimming signal.

BACKGROUND OF THE INVENTION(S)

Many control circuits for lighting utilize phase cut dimming. In phase cut dimming, the leading or trailing edge of the line voltage is manipulated to reduce the RMS voltage provided to the light. When used with incandescent lamps, this reduction in RMS voltage results in a corresponding reduction in current and, therefore, a reduction in power consumption and light output. As the RMS voltage decreases, the light output from the incandescent lamp decreases.

An example of a cycle of a full wave rectified AC signal is provided in FIG. 1A, a cycle of a phase cut rectified AC waveform is illustrated in FIG. 1B and a cycle of a reverse phase cut AC waveform is illustrated in FIG. 1C. As seen in FIGS. 1A through 1C, when phase cut dimming is utilized, the duty cycle of the resulting rectified waveform is changed. This change in duty cycle, if sufficiently large, is noticeable as a decrease in light output from an incandescent lamp. The "off" time does not result in flickering of the incandescent lamp because the filament of an incandescent lamp has some thermal inertia and will remain at a sufficient temperature to emit light even during the "off" time when no current flows through the filament.

In addition to control of the AC signal, other techniques for dimming light sources include 0-10V dimming and pulse width modulation (PWM) dimming. In 0-10V and PWM dimming, a dimming signal separate from the AC signal is provided to the light source. In 0-10V dimming, the dimming signal is a voltage level between 0 and 10V DC. The light source has a 100% output at 10V DC and a minimum output at 1V DC. Additional details on 0-10V dimming can be found in IEC Standard 60929. 0-10V dimming is conventionally used to dim fluorescent lighting.

In PWM dimming, a square wave is provided as the dimming signal. The duty cycle of the square wave can be used to control the light output of the light source. For example, with a 50% duty cycle, the output of the light source may be dimmed 50%. With a 75% duty cycle, the light output may be 75%. Thus, the light output of the light source may be proportional to the duty cycle of the input square wave.

Recently, solid state lighting systems have been developed that provide light for general illumination. These solid state lighting systems utilize light emitting diodes or other solid state light sources that are coupled to a power supply that receives the AC line voltage and converts that voltage to a voltage and/or current suitable for driving the solid state light emitters. Typical power supplies for light emitting diode light sources include linear current regulated supplies and/or pulse width modulated current and/or voltage regulated supplies.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Bergjohansen, U.S. Pat. No. 7,202,608 to Robinson et al, U.S. Pat. No, 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

In the general illumination application of solid state light sources, one desirable characteristic is to be compatible with existing dimming techniques. In particular, dimming that is based on varying the duty cycle of the line voltage may present several challenges in power supply design for solid state lighting. Unlike incandescent lamps, LEDs typically have very rapid response times to changes in current. This rapid response of LEDs may, in combination with conventional dimming circuits, present difficulties in driving LEDs.

For example, one way to reduce the light output in response to the phase cut AC signal is to utilize the pulse width of the incoming phase cut AC line signal to directly control the dimming of the LEDs. The 120 Hz signal of the full-wave rectified AC line signal would have a pulse width the same as the input AC signal. This technique limits the ability to dim the LEDs to levels below where there is insufficient input power to energize the power supply. Also, at narrow pulse width of the AC signal, the output of the LEDs can appear to flicker, even at the 120 Hz frequency. This problem may be exacerbated in 50 Hz systems as the full wave rectified frequency of the AC line is only 100 Hz.

Furthermore, variation in the input signal may affect the ability to detect the presence of a phase cut dimmer or may make detection unreliable. For example, in systems that detect the presence of a phase cut dimmer based on detection of the leading edge of the phase cut AC input, if a reverse-phase cut dimmer is used, the dimming is never detected.

Likewise, many residential dimmers have substantial variation in pulse width even without changing the setting of a dimmer. If a power supply detects the presence of dimming based on a threshold pulse width, the power supply could detect the presence of dimming on one cycle and not on another as a result of this the variation in pulse width.

A further issue relates to AC dimmers providing some phase cut even at "full on." If the LEDs are directly controlled by the AC pulse width, then the LEDs may never reach full output but will dim the output based on the pulse width of the "full on" signal. This can result in a large dimming of output. For example, an incandescent lamp might see a 5% reduction in power when the pulse width is decreased 20%. Many incandescent dimmers have a 20% cut in pulse width at full on, even though the RMS voltage is only reduced 5%. While this would result in a 5% decrease in output of an incandescent, it results in a 20% decrease in output if the phase cut signal is used to directly control the LEDs.

SUMMARY OF THE INVENTION(S)

The dimming signal generation circuits described herein may provide for a common basic circuit that may be used for differing types of dimming signals, including dimming directly from a phase cut input AC line, DC voltage level dimming (e.g., 0-10V DC dimming) and/or PWM dimming. Embodiments of the present inventive subject matter may be particularly well suited to controlling a drive circuit for solid state lighting devices, such as LEDs.

Some embodiments of the present inventive subject matter provide a lighting control circuit that comprises a dimming level detection circuit configurable to generate a first voltage level signal corresponding to a selected one of at least two different types of dimming signals. The types of dimming signals comprise at least two of an alternating current (AC) phase cut dimming signal, a direct current (DC) voltage level dimming signal or a pulse-width modulated (PWM) dimming signal. The circuit also includes a waveform generator configured to output a periodic waveform and a comparator circuit configured to compare the periodic waveform with the first voltage level signal to generate an output waveform having a duty cycle corresponding to a dimming level of the one of the at least two different input dimming signals and a frequency corresponding to the frequency of the periodic waveform.

In some embodiments, the dimming level detection circuit is user configurable to generate the voltage level from one of the at least two different input dimming signals. In other embodiments, the dimming level detection circuit is preconfigured to generate the voltage level from one of the at least two different input dimming signals. In still further embodiments, the dimming level detection circuit is configurable by electrical jumper configuration. Additionally, the dimming level detection circuit may be configurable by component selection and/or by connection to different input connectors associated with the at least two different types of dimming signals.

In further embodiments, the lighting control circuit further comprises a shutdown comparator circuit which is configured to compare the first voltage level signal with a shutdown threshold voltage and to generate a shutdown signal based on the comparison.

The dimming level detection circuit may comprise a wired OR circuit of voltage levels corresponding to the at least two different types of dimming signals. The dimming level detection circuit may also comprise a duty cycle detection circuit and an averaging circuit. The averaging circuit may comprise a first averaging circuit configured to average a detected duty cycle of an AC dimming signal and a second averaging circuit configured to average a duty cycle of a PWM dimming signal.

DETAILED DESCRIPTION OF THE INVENTION(S)

Figure 1A:
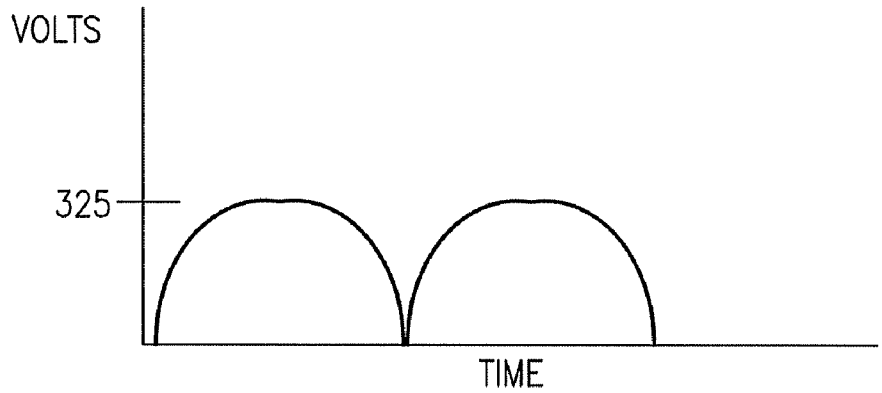
FIG.1A Prior Art
FIGS. 1A through 1C are examples of a cycle of a full wave rectified AC line signal with and without phase cut dimming.
Figure 1B:
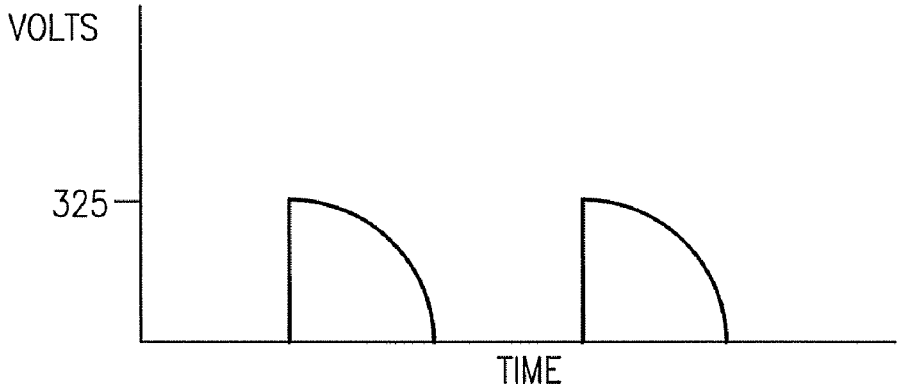
FIG.1B Prior Art
Figure 1C:
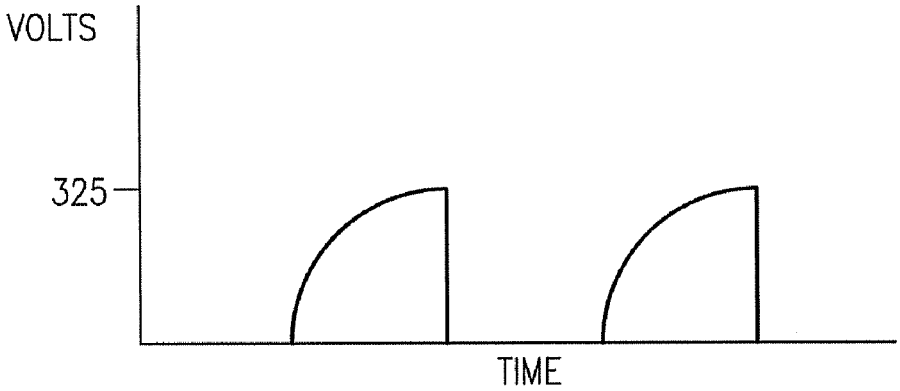
FIG.1C Prior Art

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As noted above, the various aspects of the present inventive subject matter include various combinations of electronic components (transformers, switches, diodes, capacitors, transistors, etc.). Persons skilled in the art are familiar with and have access to a wide variety of such components, and any of such components can be used in making the devices according to the present inventive subject matter. In addition, persons skilled in the art are able to select suitable components from among the various choices based on requirements of the loads and the selection of other components in the circuitry. Any of the circuits described herein (and/or any portions of such circuits) can be provided in the form of (1) one or more discrete components, (2) one or more integrated circuits, or (3) combinations of one or more discrete components and one or more integrated circuits.

A statement herein that two components in a device are "electrically connected," means that there are no components electrically between the components, the insertion of which materially affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board or another medium, are electrically connected.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

Figure 2:
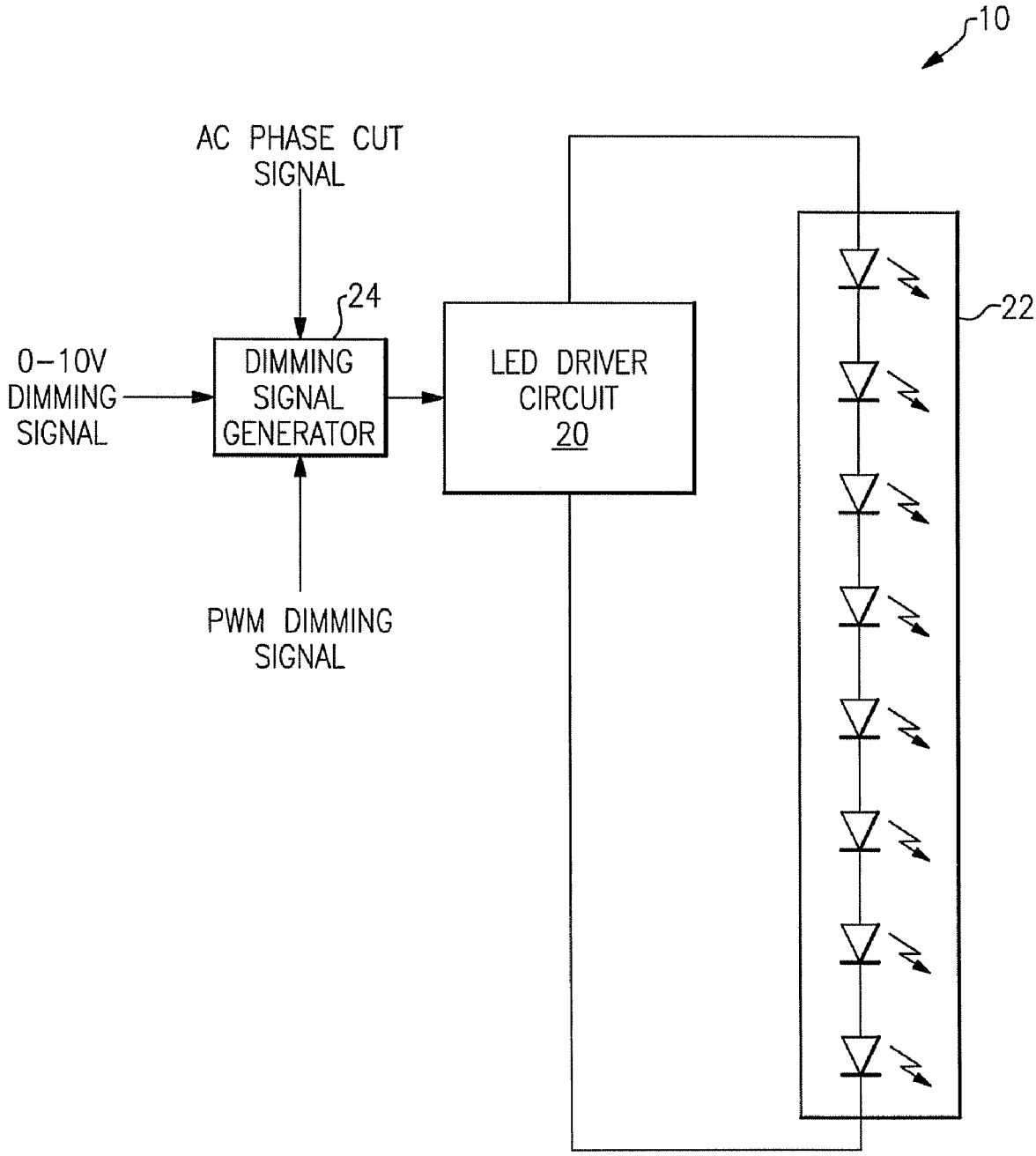
FIG. 2 is a block diagram of a lighting device incorporating dimming signal generation according to some embodiments of the present inventive subject matter.

FIG. 2 is a block diagram of a lighting device 10 incorporating embodiments of the present inventive subject matter. As seen in FIG. 2, the lighting device 10 includes a driver circuit 20 and one or more LEDs 22. The LED driver circuit 20 is responsive to a dimming signal generator circuit 24. The dimming signal generator circuit 24 receives various dimming signals, including two or more types of signals selected from (1) an AC phase cut signal, (2) a pulse width modulated (PWM) dimming signal and (3) a voltage level dimming signal (e.g., a 0-10V DC dimming signal—in the description below, including descriptions of specific embodiments, reference is made to 0-10V DC dimming signals as a representative type of voltage level dimming signal—it should be recognized, however, that any desired reference range of voltage, i.e., other than 0-10V, may be employed, and that higher relative voltage levels can be indicative of a greater extent of dimming or can be indicative of a lesser extent of dimming). In some embodiments, a variable duty cycle input signal of a first frequency is provided to the dimming signal generator circuit 24 and the circuit 24 outputs a fixed amplitude signal having a second frequency different from the first frequency and with a duty cycle that is dependent on the corresponding input signal.

In operation, the dimming signal generator circuit 24 receives an input dimming signal and outputs a waveform of a specified frequency where the duty cycle of the output waveform is proportional to the level of dimming. With regard to the variable duty cycle input signals (e.g., the AC phase cut signal or the PWM dimming signal), the generation of the dimming signal involves generating an output signal having a duty cycle that is proportional to the duty cycle of the input signal. With regard to the 0-10V dimming, generation of the dimming signal involves generating an output signal having a duty cycle that is proportional to the voltage level of the 0-10V dimming signal.

With regard to input signals that have variable duty cycle (e.g., the AC phase cut signal or the PWM dimming signal), the duty cycle of the output waveform of the dimming signal generator circuit 24 may be substantially the same as the duty cycle of the input signal(s) or it may differ according to a predefined relationship. For example, the duty cycle of the output waveform may have a linear or non-linear relationship to the duty cycle of the input signal. Likewise, the duty cycle of the output waveform will typically not track the duty cycle of the input waveform on a cycle by cycle basis. Such may be beneficial if substantial variations may occur in the duty cycle of the variable duty cycle waveform, for example as may occur in the output of a conventional AC phase cut dimmer even without changing the setting of the dimmer. Therefore, the output waveform of the dimming signal generator circuit 24 will, in some embodiments, have a duty cycle that is related to a smoothed or average duty cycle of the input signal. This smoothing or averaging of the input duty cycle may reduce the likelihood that unintended variations in the duty cycle of the input waveform will result in undesirable changes in intensity of the light output by the lighting device 10 while still allowing for changes in the dimming level. Further details on the operation of duty cycle detection and frequency conversion circuits according to some embodiments of the present inventive subject matter are provided below.

With regard to the 0-10V dimming signal, the duty cycle of the output waveform of the dimming signal generator circuit 24 may vary linearly, non-linearly or both with respect to the voltage level of the input signal. For example, the duty cycle of the output waveform may have a linear relationship to the voltage level of the input signal over a first range of voltages and a fixed or non-linear relationship over another range of voltages. In particular, the duty cycle of the output waveform may be reduced to a minimum duty cycle when the input voltage level is reduced from 10V to 1V and then maintained at that minimum duty cycle from 1V to 0V. Likewise, the duty cycle of the output waveform will typically not track minor variations in dimming signal voltage level. Such may be beneficial if variations may occur in the voltage level of the dimming signal without changing the setting of the dimmer. Therefore, the output waveform of the dimming signal generator circuit 24 will, in some embodiments, have a duty cycle that is related to a smoothed or average of the voltage level of the input signal. This smoothing or averaging of the voltage level may reduce the likelihood that unintended variations in the voltage level of the input waveform will result in undesirable changes in intensity of the light output by the lighting device 10 while still allowing for changes in the dimming level.

The driver circuit 20 may be any suitable driver circuit capable of responding to a pulse width modulated input that reflects the level of dimming of the LEDs 22. The particular configuration of the LED driver circuit 20 will depend on the application of the lighting device 10. For example, the driver circuit may be a boost or buck power supply. Likewise, the LED driver circuit 20 may be a constant current or constant voltage pulse width modulated power supply. For example, the LED driver circuit may be as described in U.S. Pat. No. 7,071,762. Alternatively, the LED driver circuit 20 may be a driver circuit using linear regulation, such as described in U.S. Pat. No. 7,038,399 and in U.S. Patent Application No. 60/844,325, filed on Sep. 13, 2006, entitled "BOOST/FLYBACK POWER SUPPLY TOPOLOGY WITH LOW SIDE MOSFET CURRENT CONTROL" (inventor: Peter Jay Myers; attorney docket number 931_020 PRO), and U.S. patent application Ser. No. 11/854,744, filed Sep. 13, 2007, (now U.S. Patent Publication No. 2008/0088248) entitled "Circuitry for Supplying Electrical Power to Loads," the disclosures of which are incorporated herein by reference as if set forth in their entirety. The particular configuration of the LED driver circuit 20 will depend on the application of the lighting device 10.

Figure 3:
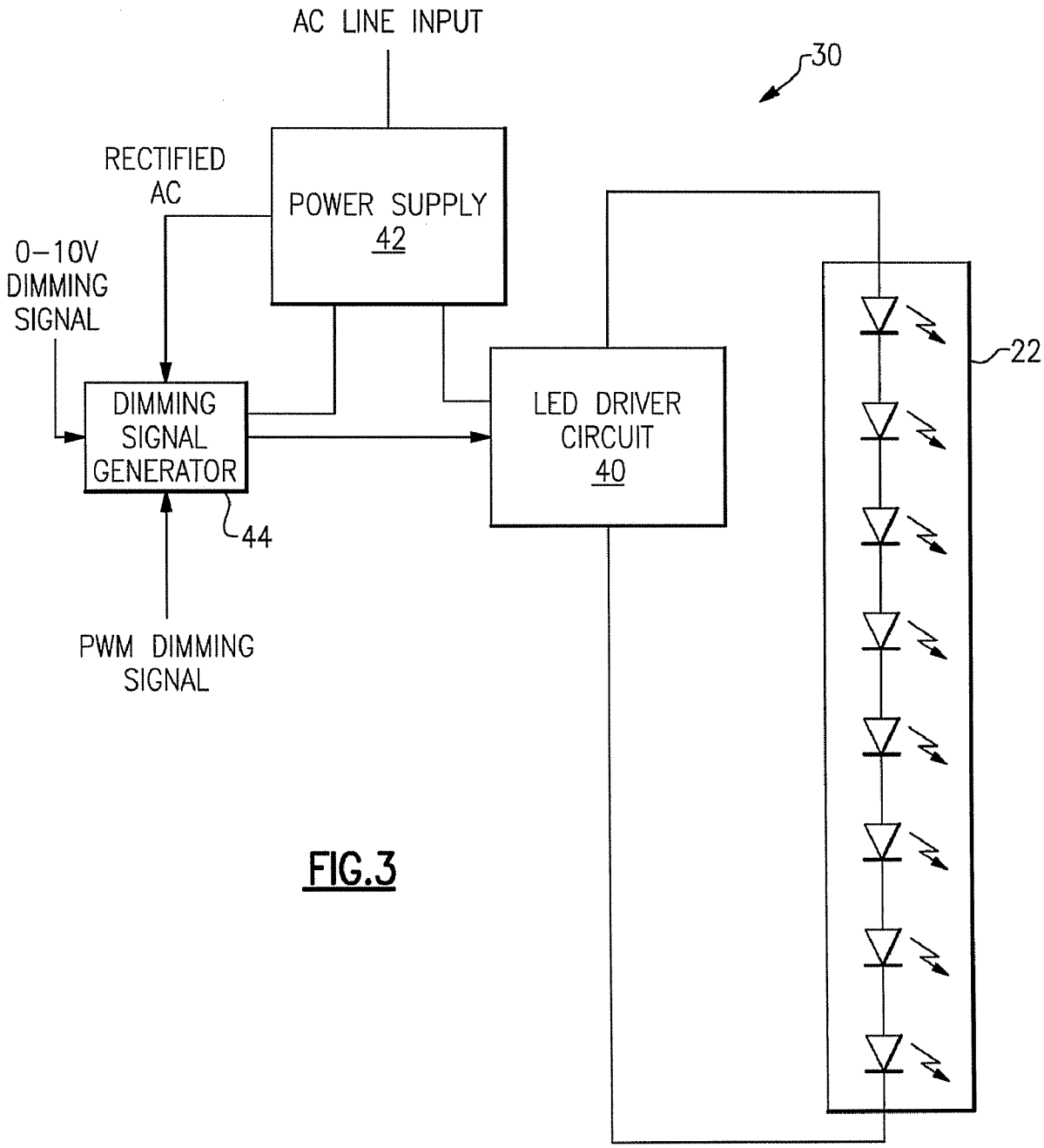
FIG. 3 is a block diagram of a lighting device suitable for use in an AC phase cut, 0-10V and/or PWM dimming system according to some embodiments of the present inventive subject matter.

FIG. 3 illustrates further embodiments of the present inventive subject matter where a lighting device 30 is powered from an AC line input where the duty cycle of the AC line input varies. Such an input may, for example, be provided by utilizing a phase cut dimmer to control the duty cycle of the AC line input. The lighting device 30 includes one or more LEDs 22, an LED driver circuit 40, a power supply 42 and a dimming signal generator circuit 44. The power supply 42 receives an AC line input and provides power to the LED driver circuit 40 and the dimming signal generator circuit 44. The power supply 42 may be any suitable power supply including, for example, buck or boost power supplies as described in U.S. patent application Ser. No. 11/854,744 (now U.S. Patent Publication No. 2008/0088248). Also, the LED driver circuit 40 may be any suitable LED driver circuit capable of varying the intensity of the output of the LEDs 22 in response to a fixed amplitude signal of variable duty cycle. The particular configurations of the LED driver circuit 40 and/or the power supply 42 will depend on the application of the lighting device 30.

The dimming signal generator circuit 44 is configured to receive at least two of (1) a PWM dimming signal, (2) a 0-10V dimming signal and (3) a rectified AC input that reflects a phase cut AC dimming signal. The dimming signal generator circuit 44 receives whichever signal (or signals) is being utilized for the dimming signal (always or at a particular time) and converts that signal into a pulse width modulated signal of a known frequency.

As is further seen in FIG. 3, the dimming signal generator circuit 44 is configured to receive the rectified AC input from the power supply 42 and detects the duty cycle of the rectified AC input. By detecting duty cycle rather than RMS voltage, the diming signal generator circuit 44 may be less sensitive to variations in the AC input voltage (for example, if duty cycle were estimated by instead tracking RMS voltage, an AC line voltage drop from 120 VAC to 108 VAC would bring about an incorrect reduction in the estimated duty cycle, i.e., variations in input voltage may be misinterpreted as changes in duty cycle and result in an undesired dimming of the light output). In contrast, by detecting duty cycle rather than RMS voltage, variations in the voltage level will only be reflected as small variations in the detected duty cycle that result from changes in slew rate for the voltage to reach the differing voltage levels.

In addition to generating a known frequency, fixed amplitude waveform having a duty cycle that is related to the dimming information of the input wave form, the dimming signal generator circuits 24 and/or 44 of FIGS. 2 and/or 3 may also detect when the dimming signal of the input waveform has fallen below a maximum dimming level and output a shutdown signal. The shutdown signal may be provided to the power supply 42 and/or the LED driver circuit 20 or 40. In some embodiments, the shutdown signal may be provided to turn off the LEDs at a time before the input power to the lighting device 10 or 30 reaches a level that is below a minimum operating level of the lighting device 10 or 30. Alternatively or additionally, the shutdown signal may be provided to turn off the LEDs at a time before the power drawn by the lighting device 10 or 30 reaches a level that is below a minimum operating power for a dimmer control device, such as a triac dimmer or other phase cut dimmer.

Figure 4:
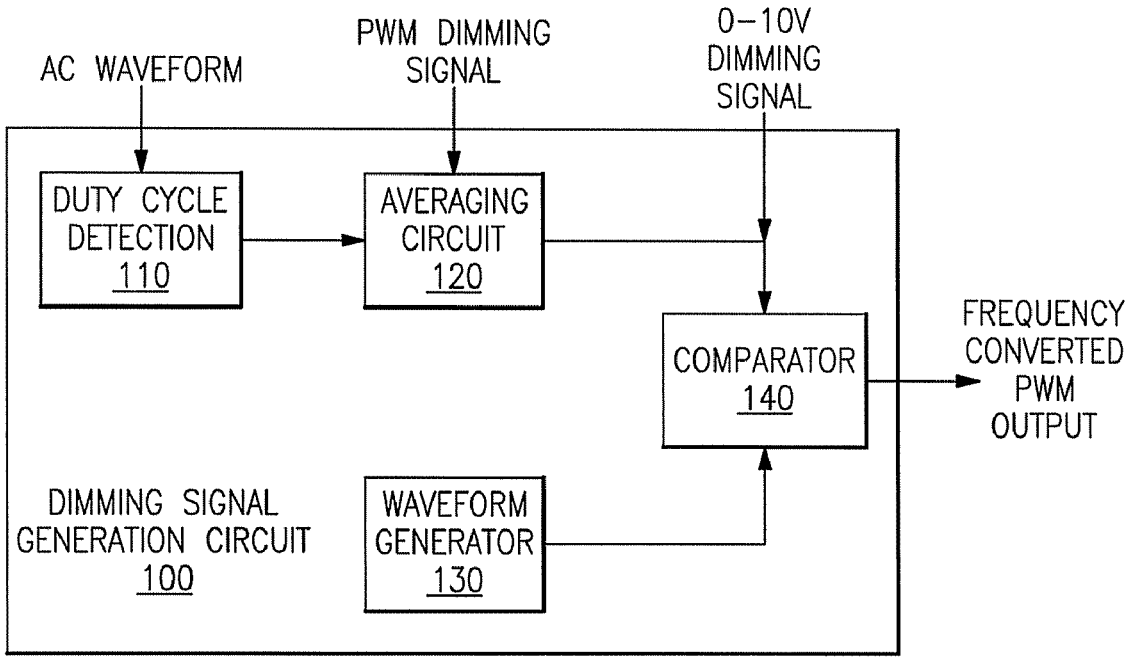
FIG. 4 is a block diagram of a dimming signal generation circuit according to some embodiments of the present inventive subject matter.

FIG. 4 illustrates functional blocks for a dimming signal generator circuit 100 according to some embodiments of the present inventive subject matter. The dimming signal generator circuit 100 is configured to receive variable duty cycle AC waveform inputs (phase cut AC dimmings signals), PWM dimming signal inputs, and/or 0-10V dimming signal inputs. For variable duty cycle AC waveform inputs, the dimming signal generator circuit 100 utilizes pulse width detection of a variable duty cycle waveform to provide a duty cycle detection circuit 110. The output of the duty cycle detection circuit 110 is a fixed amplitude waveform with a duty cycle corresponding to (i.e., based on, but not necessarily differing from) the duty cycle of the input waveform (e.g., depending on the embodiment according to the present inventive subject matter, similar to, slightly less than, related to or inversely related to the duty cycle of the input waveform). The expression "related to" encompasses relationships where the variance of the duty cycle of the output of the duty cycle detection circuit is proportional to the variance of the duty cycle of the input waveform (i.e., there is a linear relationship between the two), or where there is no linear relationship and if the duty cycle of the input waveform increases, the duty cycle of the output of the duty cycle detection circuit also increases, and vice-versa (i.e., if the duty cycle of the input waveform decreases, the duty cycle of the output of the duty cycle detection circuit also decreases); conversely, the expression "inversely related to" encompasses relationships where the variance of the duty cycle of the output of the duty cycle detection circuit is inversely proportional to the variance of the duty cycle of the input waveform, or where there is no linear inverse relationship and if the duty cycle of the input waveform decreases, the duty cycle of the output of the duty cycle detection circuit increases, and vice-versa.

The output of the duty cycle detection circuit 110 is provided to an averaging circuit 120 that creates an average value of the output of the duty cycle detection circuit. Likewise, because the PWM dimming signal is a fixed amplitude square wave with a variable duty cycle, if PWM dimming is utilized, the PWM dimming signal may be provided directly to an averaging circuit 120. In some embodiments, the average value of the respective square waves is reflected as a voltage level.

A high frequency waveform is provided by the waveform generator 130. The waveform generator 130 may generate a triangle, sawtooth or other periodic waveform. In some embodiments, the frequency of the waveform output by the waveform generator 130 is greater than 200 Hz, and in particular embodiments, the frequency is about 300 Hz (or higher). The shape of the waveform may be selected to provide the desired relationship between the dimming information contained in the input signal (duty cycle or voltage level) and the duty cycle of the pulse width modulated (PWM) output signal. The output of the waveform generator 130 and the output of the averaging circuit 120 or the input voltage level of the 0-10V dimming signal are compared by the comparator 140 to generate a periodic waveform with the frequency of the output of the waveform generator 130 and a duty cycle based on the voltage level of output of the averaging circuit 120 or the 0-10V dimming signal.

Figure 5A:
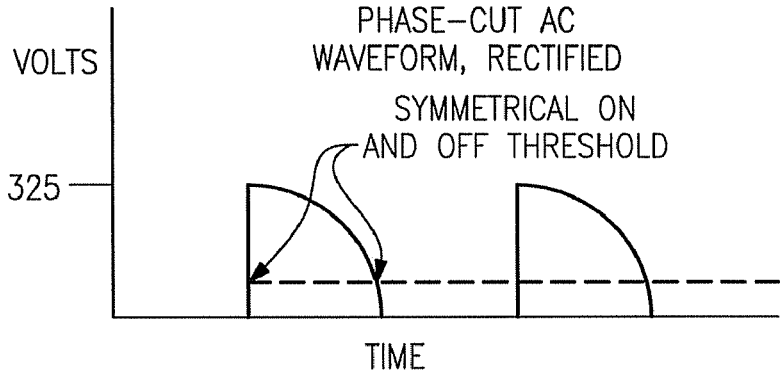
FIGS. 5A and 5B are waveform diagrams illustrating alternative duty cycle detection techniques suitable for use in duty cycle detection circuits according to some embodiments of the present inventive subject matter.
Figure 5B:
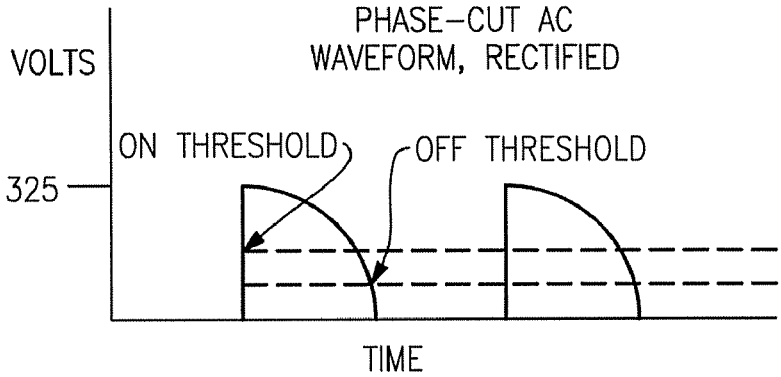

Operation of a first embodiment of a dimming signal generator circuit 100 will now be described with reference to the waveform diagrams of FIGS. 5A, 5B, 6A and 6B. In particular, FIGS. 5A and 5B illustrate duty cycle detection utilizing a symmetric threshold (FIG. 5A) and alternative embodiments utilizing asymmetric thresholds (FIG. 5B). In either case, the voltage level of the input waveform is compared to a threshold voltage.

In the symmetric example (FIG. 5A), if the input voltage (phase cut AC dimming signal) is above the threshold voltage, the output of the duty cycle detection circuit 110 is set to a first voltage level (in this embodiment, 10 volts) and if the input voltage level is below the threshold voltage, the output of the duty cycle detection circuit 110 is set to a second voltage level (in this embodiment, 0 volts, i.e., ground). Thus, the output of the duty cycle detection circuit 110 is a square wave that transitions between the first voltage level and the second voltage level (e.g., 10 V and ground). The first and second voltage levels may be any suitable voltage levels and may be selected based upon the particular averaging circuit utilized.

In the asymmetric example (FIG. 5B), if the input voltage is above a first threshold, the output of the duty cycle detection circuit 110 is set to a first voltage level and remains at that voltage level until the input voltage level falls below a second threshold voltage at which time the output of the duty cycle detection circuit 110 is set to a second voltage level. Thus, in the asymmetric example, the output of the duty cycle detection circuit 110 is also a square wave that transitions between the first voltage level and the second voltage level (e.g., 10 V and ground). As described above, the first and second voltage levels may be any suitable voltage levels and may be selected based upon the particular averaging circuit utilized. The asymmetric detection may allow for compensation for variations in the input waveform. For example, if the leading or trailing edges of a phase cut waveform intermittently include a section with a shallow slope followed or preceded by a section with a steep slope, the separate thresholds could be set to align with the section of steep slope so as to avoid minor variations in duty cycle being amplified by the shallow slope portions of the waveform.

Figure 6A:
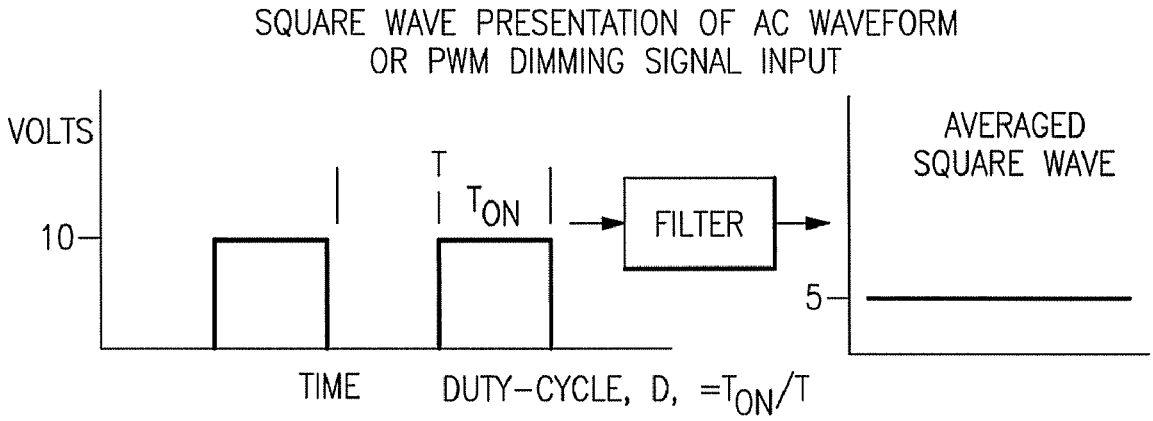
FIGS. 6A and 6B are timing diagrams illustrating operation of averaging, waveform generator and comparator circuits according to some embodiments of the present inventive subject matter.

FIG. 6A illustrates operation of the averaging circuit 120. As seen in FIG. 6A, the averaging circuit 120 averages a fixed amplitude periodic waveform (output by the duty cycle detection circuit or the PWM dimming signal input) with varying duty cycle to provide an averaged square wave signal having a voltage that (in this embodiment) represents the duty cycle of the phase cut AC dimming signal or the PWM dimming signal. The level of averaging may be set to smooth out variations in the duty cycle of the dimming signal. The input to the averaging circuit 120 may be a PWM dimming signal or the output of the duty cycle detection circuit 110.

Accordingly, where a phase cut AC dimming signal is supplied, this embodiment thus provides an averaged square wave signal which is related to the duty cycle of the input voltage. For example, if (1) the duty cycle of the phase cut AC dimming signal is 60%, (2) the duty cycle of the output of the duty cycle detection circuit is 55%, (3) the first voltage level is 10 V and (4) the second voltage level is 0 V, the voltage of the averaged square wave signal would be about 5.5 V. Alternatively, in other embodiments according to the present inventive subject matter, the averaged square wave signal can instead be inversely related to the duty cycle of the phase cut AC dimming signal. For example, if the first voltage level is ground and the second voltage level is 10 V, the inverse relationship would be provided (to illustrate, for such an embodiment, if (1) the duty cycle of the phase cut AC dimming signal is 85% and the threshold voltage is 0 V (e.g., zero cross detection AC sensing is employed), the duty cycle of the output of the duty cycle detection circuit would be 15% (i.e., for 85% of the time, the voltage level would be ground, which is the first voltage level, and for 15% of the time, the voltage level would be 10 V, which is the second voltage level), such that the voltage of the averaged square wave signal would be about 1.5 V (whereas if the duty cycle of the input voltage were 10%, the voltage of the averaged square wave signal would be about 9 V).

It should also be noted that it is not necessary for either of the first voltage level or the second voltage level to be zero. For instance, if (1) the duty cycle of the phase cut AC dimming signal is 80%, (2) the duty cycle of the output of the duty cycle detection circuit is 70%, (3) the first voltage level is 20 V and (4) the second voltage level is 10 V, the voltage of the averaged square wave signal would be about 17 V (i.e., the voltage of the averaged square wave signal would be between 10 V and 20 V, and would vary within that range proportionally to the duty cycle of the output of the duty cycle detection circuit).

Figure 6B:
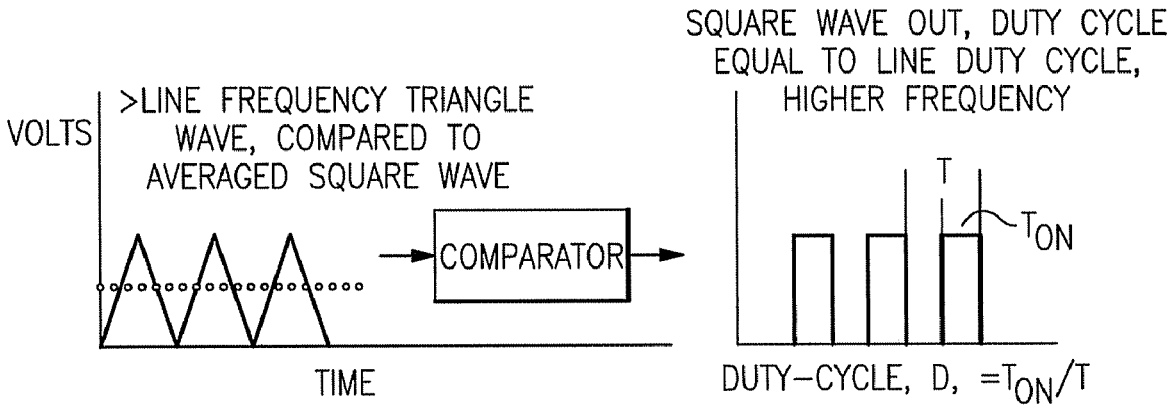

FIG. 6B illustrates the generation of the frequency shifted variable duty cycle output. As seen in FIG. 6B, while the input voltage to the comparator (i.e., the output of the averaging circuit 120 or the 0-10V dimming signal) is greater than the voltage of the output of the waveform generator 130, the output of the comparator 140 is set to a first voltage level, and while the value of the output of the averaging circuit 120 (or the 0-10V dimming signal) is below the voltage of the output of the waveform generator 130, the output of the comparator 140 is set to a second voltage level, e.g., ground (i.e., whenever the plot of the voltage of the averaging circuit (or the 0-10V dimming signal) crosses the plot of the output of the waveform generator to become larger than the output of the waveform generator, the output of the comparator is switched to the first voltage level, and whenever the plot of the voltage of the averaging circuit (or the 0-10V dimming signal) crosses the plot of the output of the waveform generator to become smaller than the output of the waveform generator, the output of the comparator is switched to the second voltage level). Thus, the output of the comparator 140 is a square wave that transitions between the first voltage level and the second voltage level (e.g., 10 V and ground), has a duty cycle that corresponds to the level of the voltage (1) output by the averaging circuit 120 or (2) input as a 0-10V dimming signal, and has a frequency corresponding to the frequency of the output of the waveform generator 130. The first and second voltage levels may be any suitable voltage levels and may be selected based upon the particular LED driver circuit with which the duty cycle detection and frequency conversion circuit 100 is being utilized.

In embodiments in which the duty cycle of the duty cycle detection circuit is inversely related to the input voltage (as discussed above), while the voltage of the averaged square wave signal (i.e., the output of the averaging circuit 120) (or the 0-10V dimming signal) is greater than the voltage of the output of the waveform generator 130, the output of the comparator 140 is instead set to a second voltage level (e.g., ground), and while the value of the output of the averaging circuit 120 (or the 0-10V dimming signal) is below the voltage of the output of the waveform generator 130, the output of the comparator 140 is instead set to a first voltage level, with the result that, as with the embodiment shown in FIG. 6B, the comparator 140 is a square wave that transitions between the first voltage level and the second voltage level (e.g., 10 V and ground), has a duty cycle that corresponds to the level of the voltage output by the averaging circuit 120 (or that inversely corresponds to the voltage level of the 0-10V dimming signal) and has a frequency corresponding to the frequency of the output of the waveform generator 130.

Figure 15A:
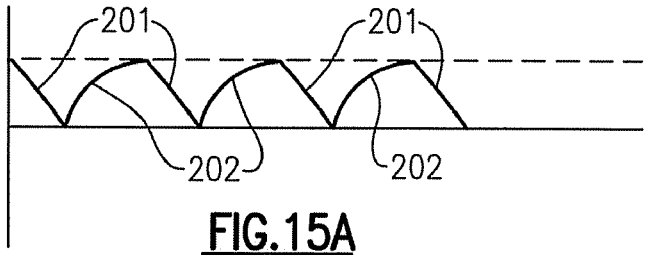
FIGS. 15A through 15E are representative examples of waveform shapes for the waveform generator according to the present inventive subject matter.
Figure 15B:
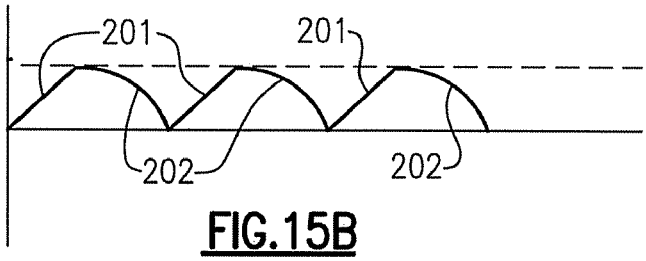
Figure 15C:
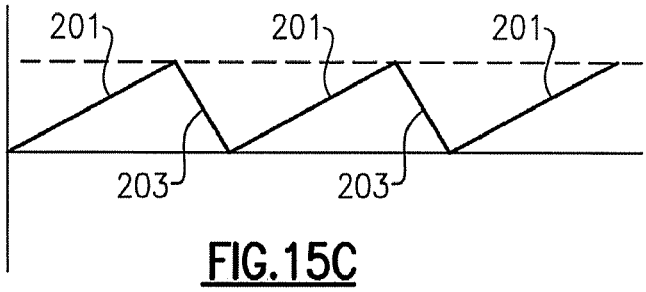
Figure 15D:
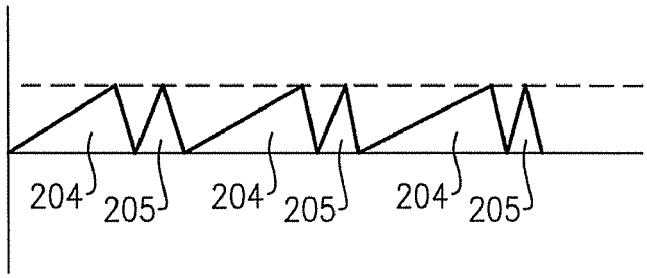
Figure 15E:
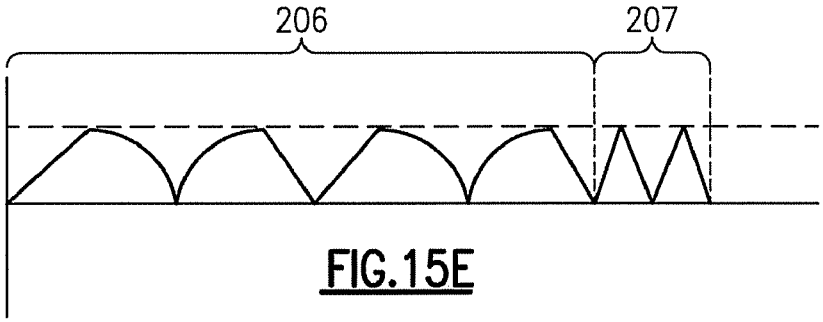

While FIG. 6B illustrates a generated waveform in the shape of a triangular sawtooth, any desired waveform shape can be employed. For example, the waveform can be of any of the shapes depicted in FIGS. 15A through 15E. FIG. 15A shows a non-linear waveform which includes linear portions 201 and curved portions 202 in a repetitive pattern. FIG. 15B shows a non-linear waveform which also includes linear portions 201 and curved portions 202 in a repetitive pattern. FIG. 15C shows a linear waveform which includes linear portions 201 and 203 which are of differing steepness (i.e., absolute value of slope). FIG. 15D shows a linear waveform which consists of a repeating pattern which includes two differently-shaped sub-portions 204 and 205. FIG. 15E shows a non-linear waveform which consists of a repeating pattern which includes two differently-shaped sub-portions 206 and 207. It is readily seen that there are an infinite number of possible waveforms, and persons skilled in the art can readily select any desired waveform in order to achieve desired characteristics.

As can be seen from FIGS. 5A through 6B, the shape of the waveform output from the waveform generator 130 may affect the relationship between (1) the input dimming signal (i.e., the phase cut AC dimming signal, the 0-10V dimming signal and/or the PWM dimming signal) and (2) the output duty cycle of the dimming signal generator circuit 100. If the waveform is linear (i.e., consists of linear and/or substantially linear segments) in the range over which the voltage output by the averaging circuit 120 and the 0-10V dimming signal operate, then the relationship between input dimming signal and output duty cycle will be linear. If the waveform is non-linear in at least part of the range over which the voltage output by the averaging circuit 120 or the 0-10V dimming signal operates, then the relationship between input dimming signal and output duty cycle will be non-linear.

Likewise, offsets between the input dimming signal and the output duty cycle may be provided by a DC offset which adjusts the waveform output from the waveform generator 130 and/or the voltage level output from the averaging circuit 120. For example, in a system in which the voltage level of the averaged square wave is related to (or proportional to) the duty cycle of the phase cut AC dimming signal or the PWM dimming signal, and in which the frequency shifted variable duty cycle output is a first voltage level when the voltage of the averaged square wave signal or the 0-10V dimming signal is greater than the voltage of the output of the waveform generator, if the output of the waveform generator 130 is offset such that the highest voltage level reached by the waveform is lower than the voltage output by the averaging circuit 120 with duty cycles of 90% or higher, then the output of the comparator would be a constant (DC) signal at the first voltage level except when the duty cycle of the input waveform falls below (i.e., is less than) 90% (and likewise when the 0-10V dimming signal is 9V or higher). Alternatively, a minimum threshold could also be set, for example, to comply with maximum dimming at the 1V level requirements of particular 0-10V dimming systems. Such variations could be made adjustable and/or selectable, for example, by a user. A variety of other relationships could be used, e.g., if the voltage level of the averaged square wave is inversely related to the duty cycle of the input voltage, and the frequency shifted variable duty cycle output is a first voltage level when the voltage of the averaged square wave signal is less than the voltage of the output of the waveform generator, the waveform generator can be offset such that the lowest voltage level reached by the waveform is higher than the voltage output by the averaging circuit with duty cycles of 90% or higher, such that the output of the comparator would likewise be a constant (DC) signal at the first voltage level except when the duty cycle of the input waveform falls below 90%.

Another representative example of an offset that can optionally be provided is a DC offset in which the voltage output by the averaging circuit is increased by a specific amount (i.e., in systems where the voltage level of the averaged square wave is related to the duty cycle of the input voltage) or decreased by a specific amount (i.e., in systems where the voltage level of the averaged square wave is inversely related to the duty cycle of the input voltage). Such an offset can be useful for a variety of purposes, e.g., to compensate for a circuit in which duty cycle detection (symmetric or asymmetric) does not use zero cross detection, such that even a 100% duty cycle rectified power signal would not produce a constant signal (i.e., where the voltage depicted in FIG. 6A would be at the first voltage level 100% of the time). In such a situation, the voltage output by the averaging circuit could be increased such that where the duty cycle of the rectified power signal is 100%, the output of the averaging circuit is representative of a 100% duty cycle power signal (even though the output of the duty cycle detection circuit generated in response to the input waveform exhibits the first voltage level only part of the time, e.g., 95% of the time (and thus the averaged square wave represents a percentage duty cycle which is higher, e.g., by 5%, than the percentage of the time that the square wave representation of AC phase cut exhibits the first voltage level).

Figure 7:
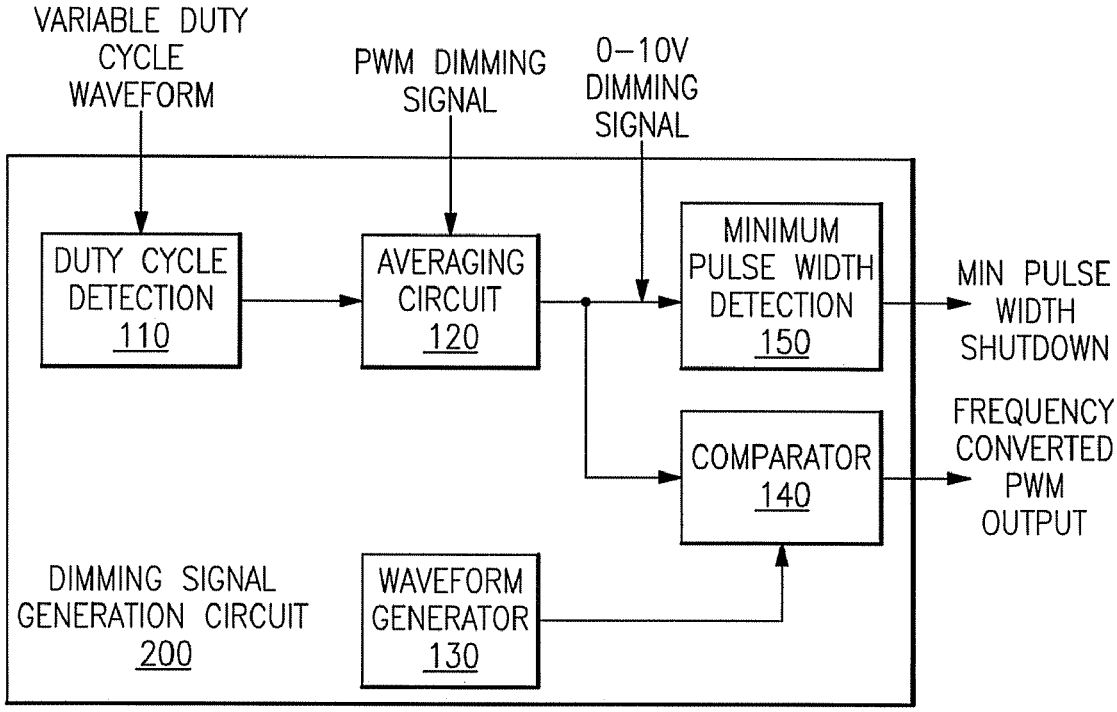
FIG. 7 is a block diagram of a dimming signal generation circuit according to further embodiments of the present inventive subject matter.

FIG. 7 illustrates further embodiments of the present inventive subject matter where the dimming signal generator circuit 200 also includes a minimum pulse width detection feature. Many triac based dimmers have performance problems at light load levels which can be present with LED based lighting products at low duty cycle dimming levels. If the triac dimmers fall below their minimum load level, their output may be unpredictable, which may result in unpredictable output from a lighting device connected to the dimmer. Likewise, if the pulse width is too small, the minimum voltage requirements of the lighting device may not be met and the power supply might be starved for power. This condition may also be undesirable. As such, the ability to shut down a power supply or lighting device before the undesirable conditions resulting from low pulse width on the line input can avoid unpredictable and undesirable performance of the lighting device. Thus, the minimum pulse width detection circuit 150 allows for setting the low level dimming point by detecting when the voltage output by the averaging circuit 120 (or the 0-10V dimming signal) falls below (or above, in embodiments where the duty cycle of the output of the duty cycle detection circuit is inversely related to the duty cycle of the input voltage) a threshold voltage associated with the minimum duty cycle for which the lighting device and/or dimmer will operate reliably.

Figure 8:
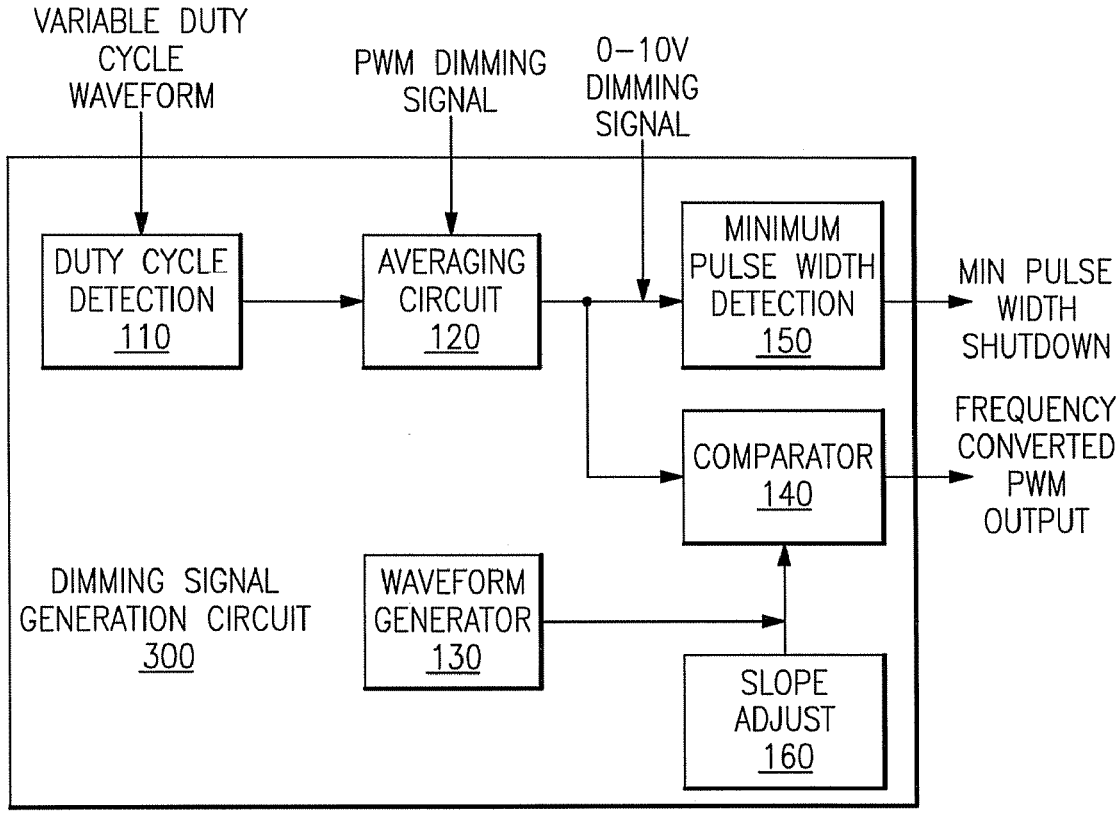
FIG. 8 is a block diagram of a dimming signal generation circuit according to further embodiments of the present inventive subject matter.

FIG. 8 illustrates still further embodiments of the present inventive subject matter. As seen in FIG. 8, the dimming signal generator circuit 300 includes a slope adjust circuit 160. The slope adjust circuit 160 provides a method to offset the duty cycle ratio between the duty cycle determined from the variable duty cycle waveform, such as a rectified AC line with phase cut dimming (or voltage level of the 0-10V dimming signal), and the PWM output provided to the LED driver circuit. This would allow for a lower light level while still maintaining a sufficient AC voltage from the triac dimmer to power a lighting device.

Figure 9:
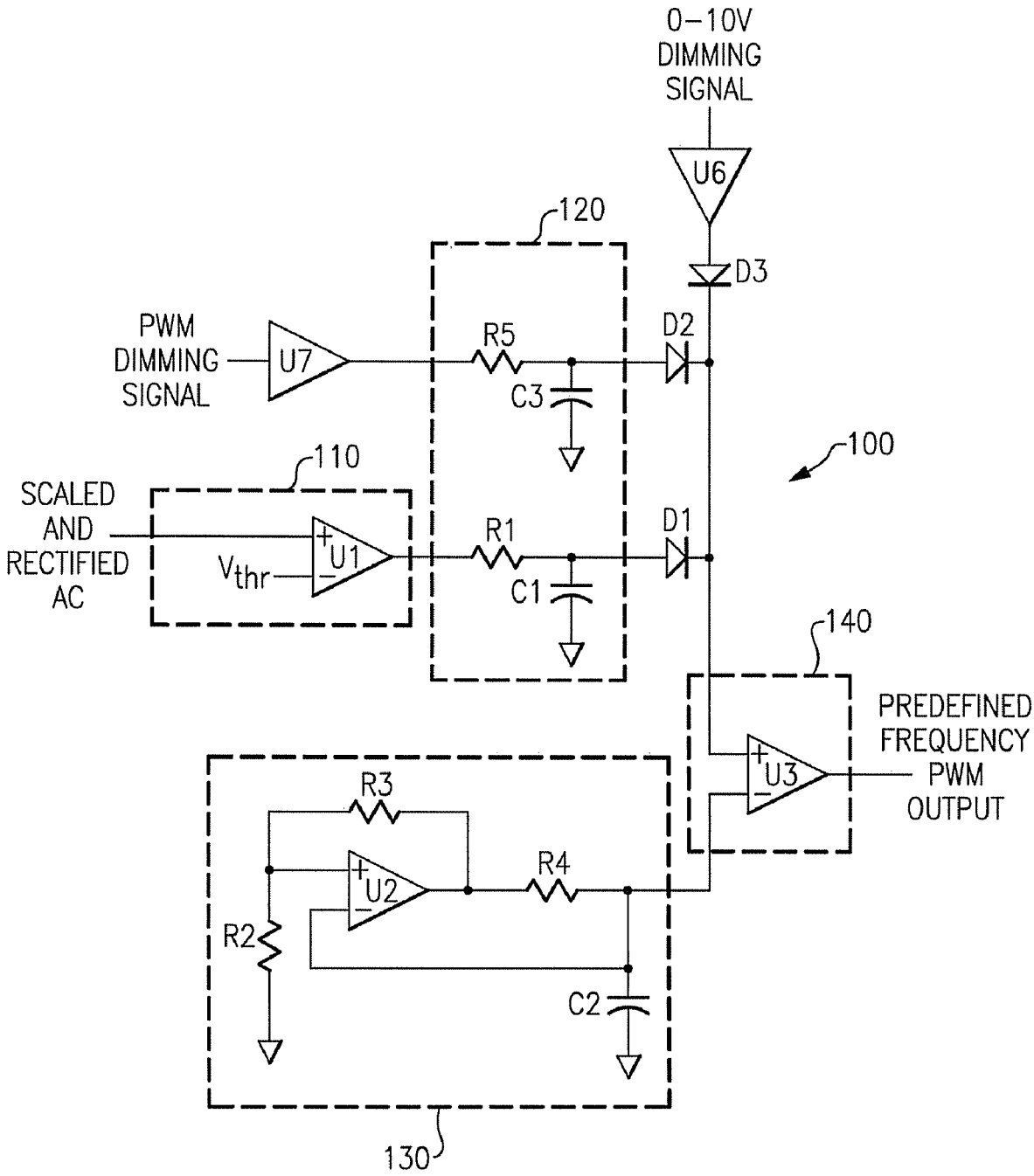
FIG. 9 is a circuit diagram of a dimming signal generation circuit according to some embodiments of the present inventive subject matter.

FIG. 9 is a circuit diagram of a dimming signal generator circuit 100 according to some embodiments of the present inventive subject matter. As seen in FIG. 9, the rectified AC line voltage is scaled to appropriate voltage levels, for example, by dividing the voltage down through a resistor divider network, and sent to the positive input of a first comparator U1. The comparator U1 compares the scaled and rectified AC to a fixed voltage reference ($V_{thr}$) at the negative input. When the positive input exceeds the negative, the output of the comparator U1 is high; when the reverse is true, the output is low (on the other hand, in embodiments where the duty cycle of the output of the duty cycle detection circuit is inversely related to the duty cycle of the input voltage, the comparator U1 is reversed, such that the rectified AC input voltage is supplied to the negative input of the comparator U1 and the fixed voltage reference is supplied to the positive input of the comparator U1). The resultant waveform is a close representation of the non-zero voltage duty-cycle of the AC line (the closer the fixed voltage reference $V_{thr}$ is to zero, the closer the resultant waveform approximates the non-zero voltage duty cycle of the AC line). The resultant waveform is a fixed amplitude square wave with a duty cycle and a frequency which correspond to the duty cycle and frequency of the rectified AC line. The reference voltage $V_{thr}$ sets the maximum pulse width of the square wave output of the comparator U1. The closer the reference voltage $V_{thr}$ is to zero volts, the greater the maximum pulse width (for example, if $V_{thr}$ is 5 V, the maximum pulse width is 100% minus the percentage of the time that the pulse is less than 5 V (the percentage of the time that the pulse is less than 5 V corresponding to the percentage of the plot, viewed along the x axis, where the plot is less than 5 V)). In some embodiments, the reference voltage may be set to a value that reduces or eliminates half cycle imbalances in a rectified triac phase cut AC waveform. Skilled artisans are familiar with ways to make the reference voltage zero (or very close to zero), e.g., by providing AC sensing detection, such as zero cross detection.

The variable duty-cycle fixed amplitude square wave from the duty cycle detection circuit 110 is then filtered by the averaging circuit 120 to create an average value; higher level for higher duty-cycles, lower level for lesser duty-cycles (the opposite is of course true in embodiments where the duty cycle of the output of the duty cycle detection circuit is inversely related to the duty cycle of the input voltage). Because the square wave is of fixed amplitude, the average value is proportional to the duty cycle of the square wave, which is proportional to the duty-cycle of the input waveform, such as the AC line input. The averaging circuit 120 is illustrated as a filter that includes resistor R1 and capacitor C1. While a single stage RC filter is illustrated in FIG. 9, other filtering or averaging techniques could be utilized. For example, in some embodiments, an RC filter with two or more stages may be used.

The averaging circuit 120 may also receive the PWM dimming signal, which is buffered by U7 (which may also translate the voltage level of the input signal to correspond to the voltage level of the output of the comparator U1), and provided to a filter. The filter is illustrated as an RC filter comprising R5 and C3. Alternative filter arrangements may also be utilized. The particular filter characteristics may, for example, depend on the frequency of the PWM dimming signal, the rate of change in duty cycle of the PWM dimming signal and the voltage level of the input. For example, the filter may be adjusted to filter out minor variations in duty cycle on a cycle by cycle basis.

Additionally, in some embodiments, the 0-10V dimming signal may be received by the buffer U6 and the voltage level adjusted so as to be compatible with the comparator circuit 140. The voltage conversion may be carried out by the buffer U6 and/or through resistor divider (not shown) or other techniques known to those of skill in the art.

The output(s) of the averaging circuit 120 and, optionally, the 0-10V dimming signal is/are provided (through respective diodes D1, D2 and D3 that provide an "OR" of the voltage levels) to the positive input of a second comparator U3 and is compared to a fixed-frequency fixed-amplitude triangle/sawtooth wave generated by the op amp (i.e., operational amplifier) U2, resistors R2, R3 and R4 and the capacitor C2. The triangle/sawtooth waveform is connected to the negative input of the comparator U3 (in embodiments in which the duty cycle of the output of the duty cycle detection circuit is inversely related to the duty cycle of the input voltage, the waveform is instead connected to the positive input of the comparator U3). The output of the comparator U3 is a square wave which has a duty-cycle proportional to the voltage level at the positive input of the comparator U3 (the output of the averaging circuit 120) and a frequency equal to that of the triangle/sawtooth wave. In this manner, the duty cycle of, for example, a lower frequency AC line can be translated to a higher frequency square wave. The square wave can be used to gate LEDs on and off for a dimming effect.

FIG. 9 illustrates the use of a single op amp sawtooth generator as the waveform generator 130. Other circuits may also be utilized to generate appropriate waveforms. For example, a two op amp triangle oscillator as described on page A-44 of "Op Amps for Everyone," R. Mancini, Editor, September 2000, may also be utilized. Other circuits known to those of skill in the art may also be used. When using a waveform generator such as illustrated in FIG. 9, to provide a linear relationship (or substantially linear relationship) between input and output duty cycle, the portions of the resulting waveform for the range over which the average value voltage will vary should be linear (or substantially linear). For example, the waveform generator illustrated in FIG. 9 may provide a waveform with a linear region and a non-linear region that resembles a "shark fin." If the range of voltages output by the averaging circuit 120 overlaps with the non-linear region, then a small change in input duty cycle could result in a large change in output duty cycle, or vice-versa. Such a situation may make the overall circuit susceptible to noise or too sensitive to variations in input duty cycle (e.g. too sensitive to user input at a dimmer). As a result, the circuit illustrated in FIG. 9 may be implemented such that the voltage range of the averaging circuit 120 corresponds to a linear portion or portions of the output waveform from the waveform generator 130.

As will be appreciated by those of skill in the art in light of the present disclosure, the "OR" function provided by the diodes D1, D2 and D3 may be provided by providing a low voltage level as an input to the corresponding diode for unused dimming signal inputs. For example, the 0-10V dimming input could be pulled low unless connected to a dimmer which would reverse bias the diode D3 when a signal was applied from either the PWM dimming signal input or from the scaled and rectified AC input.

Figure 10:
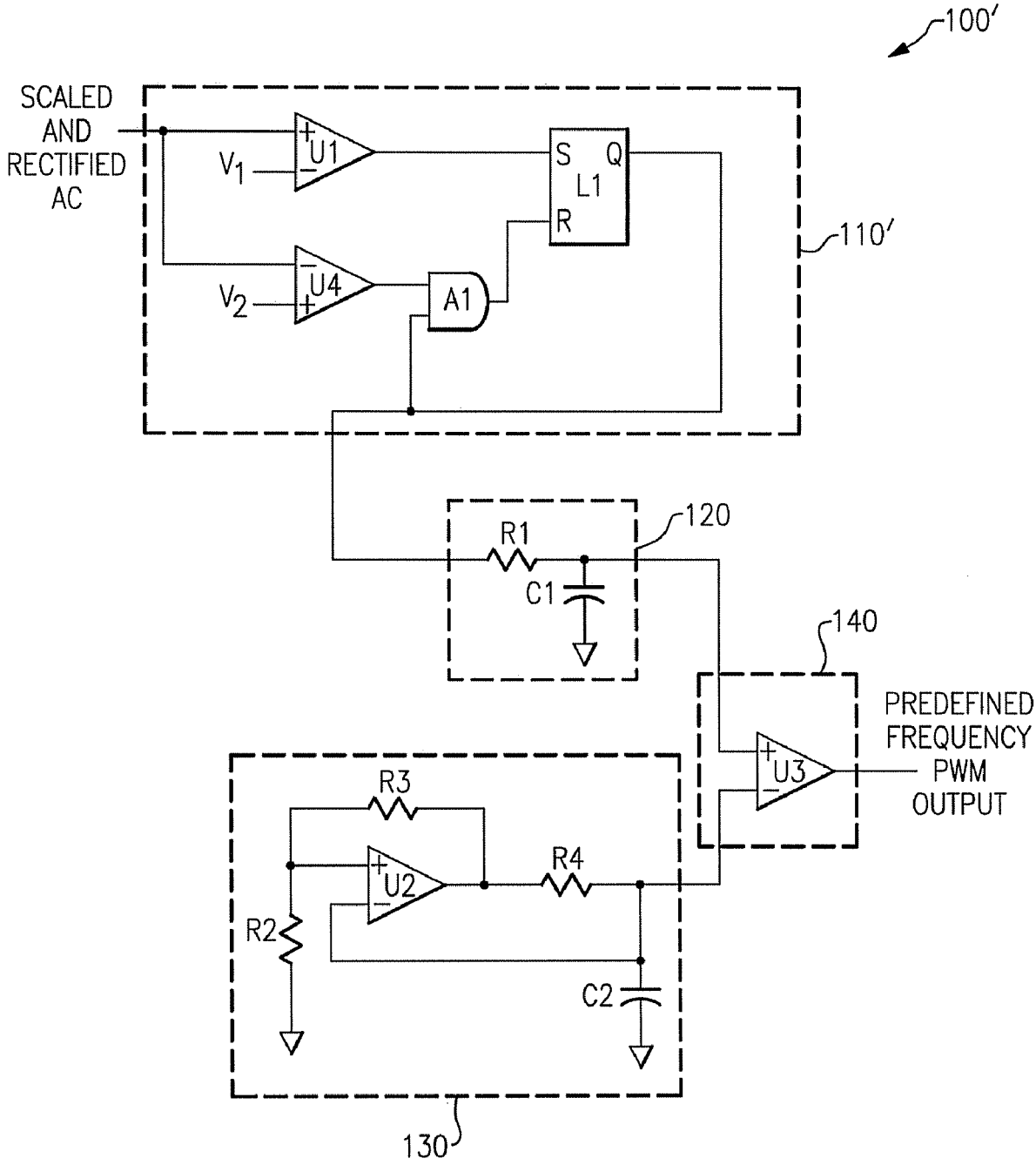
FIG. 10 is a circuit diagram of a dimming signal generation circuit utilizing asymmetric pulse width detection according to further embodiments of the present inventive subject matter.

FIG. 10 is a circuit diagram of a dimming signal generator circuit 100' that provides asymmetric threshold voltages for duty cycle detection. As seen in FIG. 10, the duty cycle detection circuit 110' includes a second comparator U4, a logic AND gate A1 and a Set/Reset latch L1 that provide independently settable on and off thresholds. As discussed above, the triac based AC waveform can have half cycle imbalances that the voltage threshold(s) critical may be set based upon to provide steady PWM duty cycle generation. The dimming signal generator circuit 100' could also incorporate the PWM dimming signal and 0-10V dimming signal circuitry as illustrated in FIG. 9.

In operation, the duty cycle detection circuit 110' sets the latch L1 when the input voltage becomes higher than the threshold voltage $V_1$ and resets the latch L1 when the input voltage falls below the threshold voltage $V_2$, where $V_1>V_2$. In particular, when the input voltage exceeds $V_1$, the output of the comparator U1 is high and the set input S of the latch L1 is high so as to cause the output Q of the latch L1 to go high. When the input voltage falls below $V_1$, the output of the comparator U1 goes low but the output Q of the latch L1 remains high. When the input further falls below $V_2$, the output of the comparator U4 goes high, therefore both inputs to the AND gate A1 are high so the output of the AND gate A1 goes high, resetting the latch L1, and the output Q goes low. While the circuit illustrated in FIG. 10 has been designed for $V_1>V_2$, a corresponding circuit where $V_1<V_2$ could be readily provided by logically ANDing the inverted output of the latch L1 with the output of comparator U1 and using the output of the AND as the set signal for the latch L1. In such a case, the AND gate A1 could be eliminated and the output of the comparator U4 provided directly to the rest of the latch L1.

Figure 11:
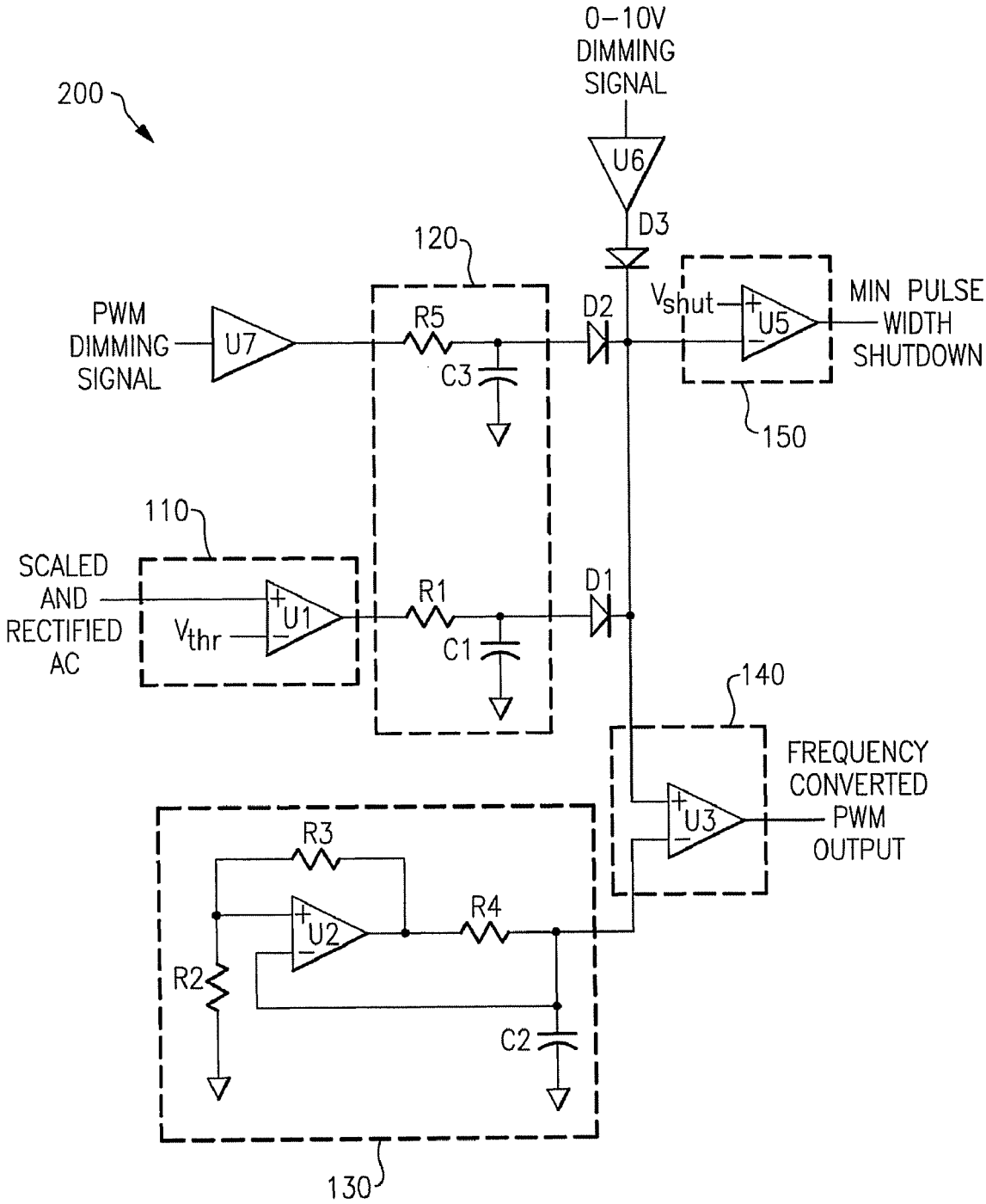
FIG. 11 is a circuit diagram of a dimming signal generation circuit according to further embodiments of the present inventive subject matter.

FIG. 11 is a circuit diagram illustrating a dimming signal generator circuit 200 that incorporates a minimum pulse width detection circuit 150. As seen in FIG. 11, the minimum pulse width detection circuit 150 is provided by the comparator U5. In particular, a reference voltage $V_{shut}$ is provided to one input of the comparator U5 and the "ORed" output of the averaging circuit 120 and/or 0-10V dimming signal is provided to the other input. In this embodiment, the output of the averaging circuit is related to the output of the duty cycle detection circuit or the PWM dimming signal. When the output of the averaging circuit or the 0-10V dimming signal falls below the reference voltage $V_{shut}$, the output of the comparator U5 goes high, thus providing a shutdown signal. In alternative embodiments, in which the output of the averaging circuit is inversely related to the output of the duty cycle detection circuit or the PWM dimming signal, the output of the comparator U5 goes high to provide a shutdown signal when the output of the averaging circuit or an inverted version of the 0-10V dimming signal rises above the reference voltage $V_{shut}$.

Figure 12:
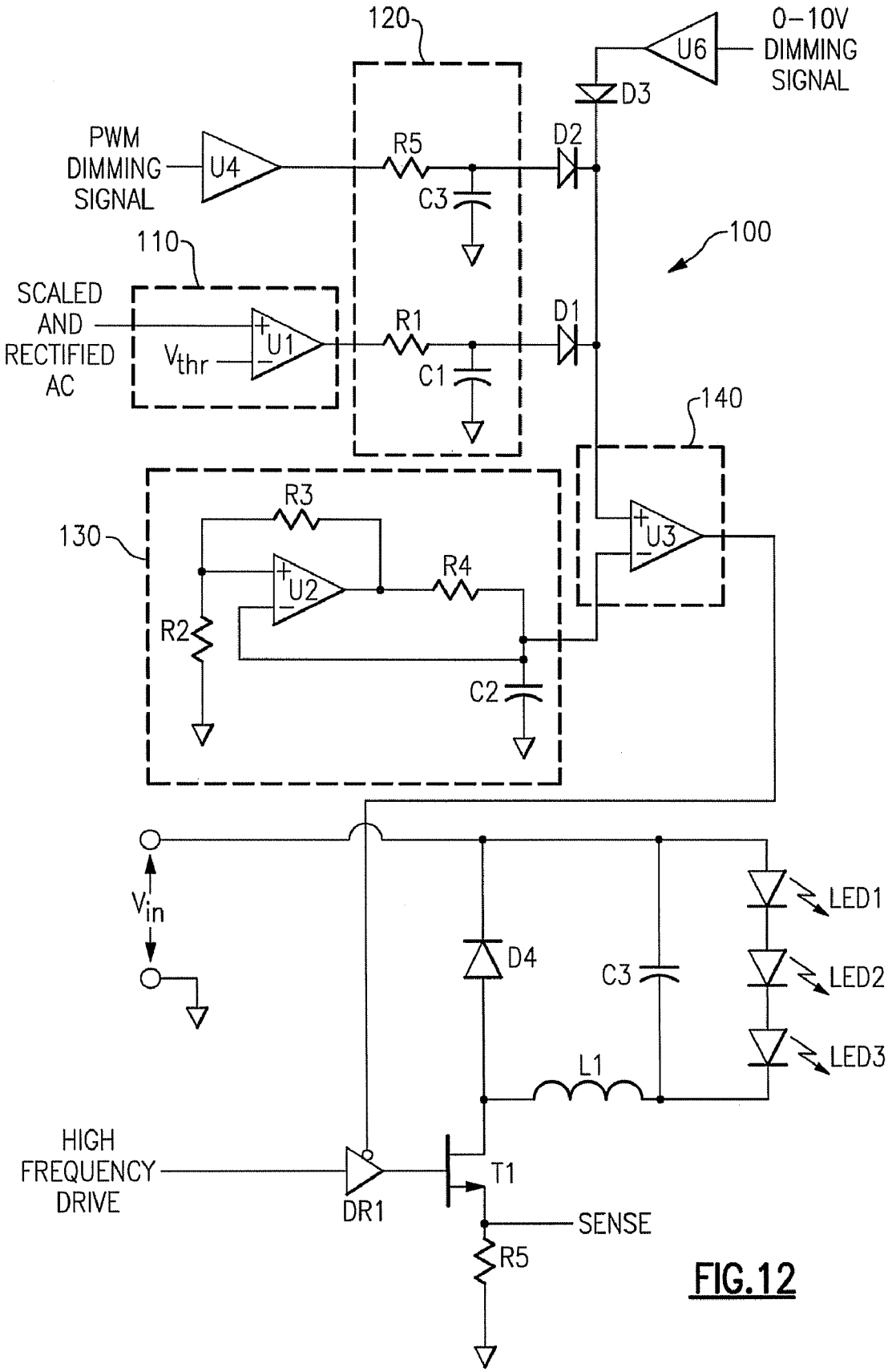
FIG. 12 is a circuit diagram of a system as illustrated in FIG. 2 according to some embodiments of the present inventive subject matter.

FIG. 12 is a circuit diagram of a dimming signal generator circuit 100 coupled to an LED driver circuit where the string of LEDs (LED1, LED2 and LED3) is driven by an input voltage that is modulated by a high frequency drive signal through the transistor T1. The diode D4, capacitor C3 and inductor L1 provide current smoothing between cycles of the high frequency drive signal. The resistor R5 provides a current sense that can be fed back to a driver controller that varies the duty cycle of the high frequency drive signal to provide constant current to the LEDs. The gate of the transistor T1 is controlled by the driver DR1. The driver is enabled by the output of the dimming signal generator circuit 100 so that the high frequency drive signal is controlled by the output of the dimming signal generator circuit 100. Because the transistor Ti is controlled by the output of the dimming signal generator circuit 100, it may be necessary to disable or otherwise control or compensate for the current sense feedback to the controller when the transistor T1 is off, as the sensed current feedback is only valid when the transistor T1 is on.

Figure 13:
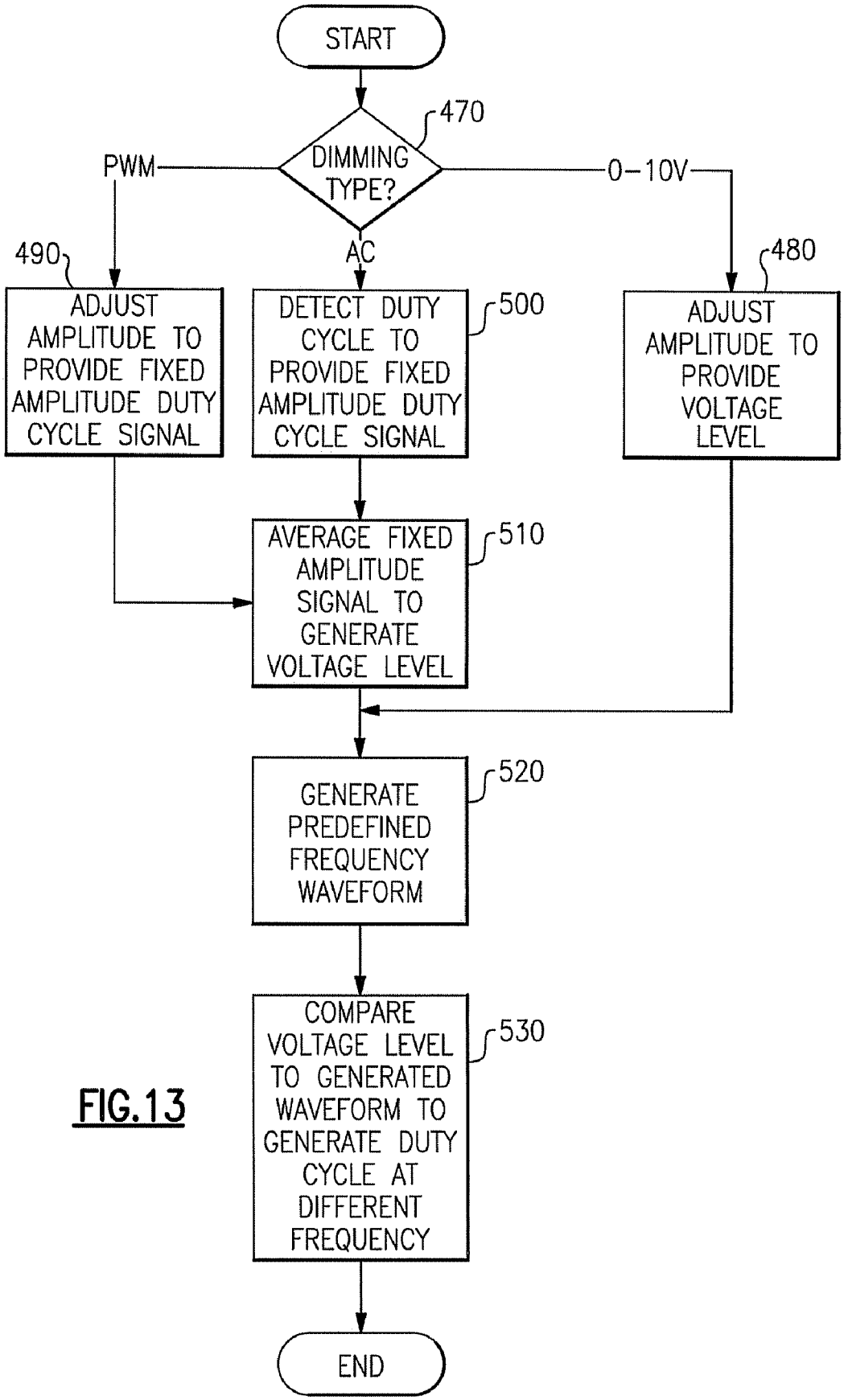
FIG. 13 is a flowchart illustration of operations of some embodiments of the present inventive subject matter.
Figure 14:
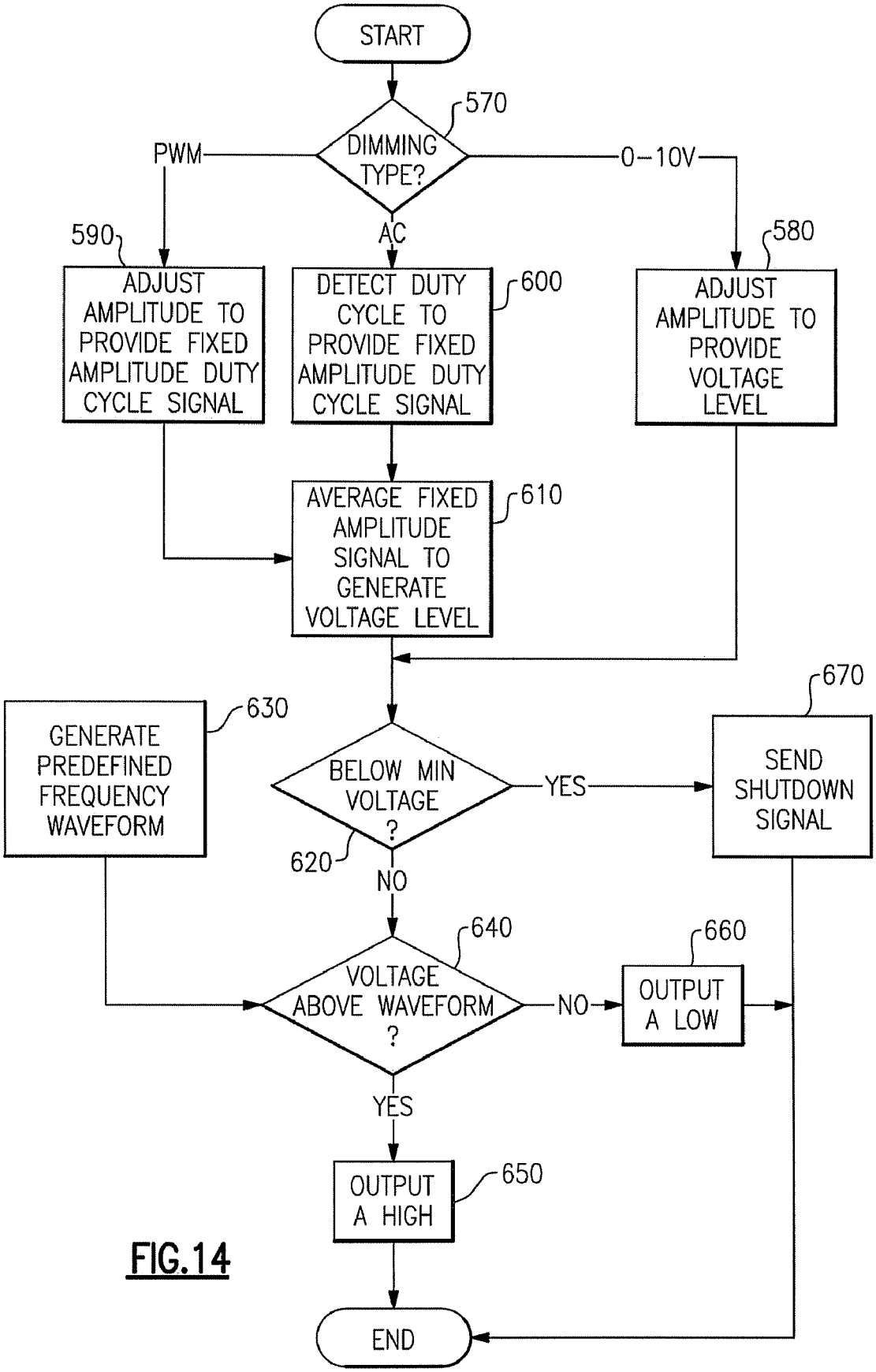
FIG. 14 is a flowchart illustration of operations according to further embodiments of the present inventive subject matter.

FIGS. 13 and 14 are flowchart illustrations of operations according to some embodiments of the present inventive subject matter. It will be appreciated that the operations illustrated in FIGS. 13 and 14 may be carried out simultaneously or in different sequences without departing from the teachings of the present inventive subject matter. Thus, embodiments of the present inventive subject matter should not be construed as limited to the particular sequence of operations illustrated by the flowcharts. Furthermore, operations illustrated in the flowcharts may be carried out entirely in hardware or in combinations of hardware and software.

Turning to FIG. 13, the type of dimming is initially determined (block 470). If the type of dimming is AC phase cut dimming (block 470), the duty cycle of the input waveform is detected to provide a fixed amplitude duty cycle signal (block 500). The average is determined of the fixed amplitude signal to generate an average value which may be reflected as a voltage level (block 510). A waveform of a different frequency from the frequency of the input signal is generated (block 520) and the value of the waveform is compared to the average value (voltage level) to generate a waveform with a duty cycle corresponding to (i.e., not necessarily the same as, but "based on") the input duty cycle at a frequency corresponding to the frequency of the generated waveform (block 530).

If the type of dimming is PWM dimming (block 470), the amplitude of the input PWM signal is adjusted to provide a fixed amplitude variable duty cycle signal (block 490). The average is determined of the fixed amplitude signal to generate an average value which may be reflected as a voltage level (block 510). A waveform of a different frequency from the frequency of the input signal is generated (block 520) and the value of the waveform is compared to the average value (voltage level) to generate a waveform with a duty cycle corresponding to (i.e., not necessarily the same as, but "based on") the input duty cycle at a frequency corresponding to the frequency of the generated waveform (block 530).

If the type of dimming is 0-10V dimming (block 470), the amplitude of the input dimming signal is adjusted to scale to the appropriate voltage level (block 480). A waveform of a different frequency from the frequency of the input signal is generated (block 520) and the value of the waveform is compared to the generated voltage level to generate a waveform with a duty cycle corresponding to (i.e., not necessarily linearly related to, but "based on") the voltage level dimming signal at a frequency corresponding to the frequency of the generated waveform (block 530).

FIG. 14 illustrates further operations according to some embodiments of the present inventive subject matter. As seen in FIG. 14, the type of dimming is determined (block 570). If the dimming is AC phase cut dimming (block 570), the duty cycle of the input waveform is detected to provide a fixed amplitude signal with a duty cycle corresponding to the duty cycle of the input waveform (block 600). The average value of the fixed amplitude signal is determined to generate an averaged voltage corresponding to the average value of the fixed amplitude signal (block 610). The averaged voltage level is compared to a voltage level for the minimum pulse width to determine if the pulse width of the input signal is less than the minimum allowable pulse width (block 620). If the averaged voltage level is below this level (block 620), the shutdown signal is provided (block 670). If the averaged voltage level is above the minimum allowable pulse width level (block 620), the averaged voltage level is compared to the voltage of a generated waveform (block 640). The generated waveform may be of a frequency different from that of the input signal (block 630). If the averaged voltage level is above the voltage of the generated waveform (block 640), a high signal is output (block 650). If the averaged voltage is below the voltage of the generated waveform (block 640), a low signal is output (block 660).

If the dimming is PWM dimming (block 570), the amplitude of the input signal is adjusted to provide a fixed amplitude signal (block 600). The average value of the fixed amplitude signal is determined to generate an averaged voltage corresponding to the average value of the fixed amplitude signal (block 610). The averaged voltage level is compared to a voltage level for the minimum pulse width to determine if the pulse width of the input signal is less than the minimum allowable pulse width (block 620). If the averaged voltage level is below this level (block 620), the shutdown signal is provided (block 670). If the averaged voltage level is above the minimum allowable pulse width level (block 620), the averaged voltage level is compared to the voltage of a generated waveform (block 640). The generated waveform may be of a frequency different from that of the input signal (block 630). If the averaged voltage level is above the voltage of the generated waveform (block 640), a high signal is output (block 650). If the averaged voltage is below the voltage of the generated waveform (block 640), a low signal is output (block 660).

If the dimming is 0-10V dimming (block 570), the amplitude of the input signal is adjusted to provide a voltage level within a predefined range corresponding to the range of average value voltage levels (block 580). The voltage level is compared to a voltage level for the minimum pulse width to determine if the pulse width of the input signal is less than the minimum allowable pulse width (block 620). If the voltage level is below this level (block 620), the shutdown signal is provided (block 670). If the voltage level is above the minimum allowable pulse width level (block 620), the voltage level is compared to the voltage of a generated waveform (block 640). The generated waveform may be of a frequency different from that of the input signal (block 630). If the averaged voltage level is above the voltage of the generated waveform (block 640), a high signal is output (block 650). If the averaged voltage is below the voltage of the generated waveform (block 640), a low signal is output (block 660).

The generation of a square wave representation of an input waveform duty cycle, such as the AC line voltage, in this manner is tolerant of variations in line voltage and frequency, i.e. the square wave will remain the same even if the AC line voltage or frequency increases or decreases due to utility generation, load adding or shedding, or other reasons. A circuit which, unlike the present invention, filters the rectified line would be unable to differentiate between changes in duty cycle and changes in line voltage, and the representative filtered level would change in response—the present inventive subject matter overcomes these drawbacks.

The generated waveform used as the comparison source for the final output may be altered in frequency or shape. Altering the shape of the generated waveform can change the proportional response of the output to the input dimming signal, e.g., if desired, to create a highly non-linear dimming response to the input dimming signal.

The higher frequency output, used as a manner to switch on and off the LEDs, can eliminate human visible flicker, and/or the flicker as recorded by electronics such as video cameras.

Using the methods and circuits according to the present inventive subject matter, a light or a set of lights connected to a driver as described herein can be connected to a power source, through a circuit in accordance with the present inventive subject matter, without concern as to the frequency of the voltage from the power source and/or the voltage level of the power source. To illustrate, skilled artisans are familiar with a variety of situations in which the frequency of the line voltage is 50 Hz, 60 Hz, 100 Hz or other values (e.g., if connected to a generator, etc.) and/or in which the line voltage can change or vary, and the problems that can be caused, particularly with conventional dimmers, when connecting a light or set of lights to such line voltage. With circuitry as described herein, a light or set of lights can be connected to line voltages of widely differing frequencies and/or which vary in voltage level, with good results.

In addition, the present inventive subject matter has been described with regard to dimming, but the present inventive subject matter is also applicable to modifying other aspects of the light output, e.g., color temperature, color, hue, brightness, characteristics of the outputs of the light, CRI Ra, etc. For example, a lighting control circuit can be configured such that when the duty cycle of the input voltage is a certain percentage (e.g., 10%), the circuitry can cause the output of the device to have a particular color temperature (e.g., 2,000 K). For instance, with natural light, as the light dims, the color temperature typically decreases, and it might be deemed desirable for the lighting device to mimic this behavior. In addition, with security lighting, it can be desirable for dimmed lighting to have low CRI, such that there is enough light that an intruder can be observed, but the CRI Ra is low enough that the intruder has difficulty seeing what he or she is doing.

The circuits and methods according to the present inventive subject matter are not limited to AC power or to AC phase cut dimmers. Rather, the present inventive subject matter is applicable to all types of dimming using waveform duty cycle (e.g., including pulse width modulation).

While embodiments of the present inventive subject matter have been described with reference to a circuit capable of being used with three different types of dimming control, the present inventive subject matter also includes circuits that may be used with any two of the different dimming control techniques. Thus, a dimming signal generation circuit may be capable of operation with more than one type of dimming control signal. However, the circuit need only be capable of operation with one type of dimming control signal at a time to still benefit from teachings of the present inventive subject matter. For example, the same or substantially the same dimming signal generation circuit could be provided in a luminaire and the user would connect only one type of dimming control device to the luminaire. Thus, the luminaire would be compatible with multiple dimming control methods but would only be used with one at a time.

Furthermore, benefits of the present inventive subject matter may also be obtained even in cases where the luminaire is preconfigured to be compatible with only one dimming solution. In such a case, the same basic circuit topology could be utilized for various dimming control methods and jumpers or changes in passive components could be utilized to tailor the circuit for the desired dimming solution. Such a system may provide advantages in manufacturing as common parts between the different systems could be purchased based on total unit production. Furthermore, partial circuits could be assembled and inventoried and then tailored to the specific dimming method at final manufacturing time. This could reduce the number of intermediate components that would need to be inventoried during the production process.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the devices described herein can be integrated. Any structural part of the devices described herein can be provided in two or more parts (which are held together, if necessary). Similarly, any two or more functions can be conducted simultaneously, and/or any function can be conducted in a series of steps.

That which is claimed is:

1. A lighting control circuit comprising:

a dimming level detection circuit configurable to generate a first voltage level signal corresponding to a selected one of at least two different types of dimming signals, the types of dimming signals comprising at least two of an alternating current (AC) phase cut dimming signal, a direct current (DC) voltage level dimming signal or a pulse-width modulated (PWM) dimming signal;

a waveform generator configured to output a waveform generator periodic waveform; and a comparator circuit configured to compare the waveform generator periodic waveform with the first voltage level signal to generate a comparator waveform having a comparator duty cycle corresponding to a dimming level of the one of the at least two different input dimming signals and a frequency corresponding to a frequency of the waveform generator periodic waveform.

2. A lighting control circuit as recited in claim 1, wherein the dimming level detection circuit is user configurable to generate the voltage level from one of the at least two different input dimming signals.

3. A lighting control circuit as recited in claim 1, wherein the dimming level detection circuit is preconfigured to generate the voltage level from one of the at least two different input dimming signals.

4. A lighting control circuit as recited in claim 1, wherein the dimming level detection circuit is configurable by electrical jumper configuration.

5. A lighting control circuit as recited in claim 1, wherein the dimming level detection circuit is configurable by component selection.

6. A lighting control circuit as recited in claim 1, wherein the dimming level detection circuit is configurable by connection to different input connectors associated with the at least two different types of dimming signals.

7. A lighting control circuit as recited in claim 1, wherein the lighting control circuit further comprises a shutdown comparator circuit which is configured to compare the first voltage level signal with a shutdown threshold voltage and to generate a shutdown signal based on the comparison.

8. A lighting control circuit as recited in claim 1, wherein the dimming level detection circuit comprises a wired OR circuit of voltage levels corresponding to the at least two different types of dimming signals.

9. A lighting control circuit as recited in claim 1, wherein the dimming level detection circuit comprises a duty cycle detection circuit and an averaging circuit.

10. A lighting control circuit as recited in claim 9, wherein the averaging circuit comprises a first averaging circuit configured to average a detected duty cycle of an AC dimming signal and a second averaging circuit configured to average a duty cycle of a PWM dimming signal.

11. A lighting device comprising:

at least one solid state light emitter;

a lighting control circuit as recited in claim 1; and a driver circuit configured to vary the intensity of output of the at least one solid state light emitter in response to the comparator waveform.

12. A lighting device comprising:

at least one solid state light emitter;

a lighting control circuit as recited in claim 1; and means for varying the intensity of output of the at least one solid state light emitter in response to the comparator waveform.

13. A lighting control circuit comprising:

means for generating a first voltage level signal corresponding to a selected one of at least two different types of dimming signals, the types of dimming signals comprising at least two of an alternating current (AC) phase cut dimming signal, a direct current (DC) voltage level dimming signal or a pulse-width modulated (PWM) dimming signal;

means for generating a waveform generator periodic waveform; and means for comparing the waveform generator periodic waveform with the first voltage level signal to generate a comparator waveform having a comparator duty cycle corresponding to a dimming level of the selected one of at least two different types of dimming signals and a frequency corresponding to a frequency of the waveform generator periodic waveform.

14. A lighting control circuit as recited in claim 13, wherein the lighting control circuit further comprises means for comparing the first voltage level signal with a shutdown threshold voltage and generating a shutdown signal based on the comparison.

15. A method of controlling lighting, comprising:

generating a first voltage level signal based on a selected one of at least two different types of dimming signals, the types of dimming signals comprising at least two of an alternating current (AC) phase cut dimming signal, a direct current (DC) voltage level dimming signal or a pulse-width modulated (PWM) dimming signal;

generating a waveform generator periodic waveform; and comparing the waveform generator periodic wavefonn with the first voltage level signal to generate a comparator waveform having a comparator duty cycle corresponding to a dimming level of the one of the at least two different input dimming signals and a frequency corresponding to a frequency of the waveform generator periodic waveform.

16. A method as recited in claim 15, further comprising:

obtaining user input to identify the selected one of at least two different types of dimming signals.

17. A method as recited in claim 15, further comprising preconfiguring the selected one of the at least two different input dimming signals.

18. A method as recited in claim 15, further comprising setting an electrical jumper to identify the selected one of at least two different types of dimming signals.

19. A method as recited in claim 15, further comprising selecting components for a voltage generation circuit based on the selected one of at least two different types of dimming signals.

20. A method as recited in claim 15, wherein generating a first voltage level comprises generating a first voltage level based on a presence of a connection to different input connectors associated with the at least two different types of dimming signals.

21. A method as recited in claim 15, further comprising comparing the first voltage level signal with a shutdown threshold voltage and generating a shutdown signal based on the comparison.

22. A method as recited in claim 15, wherein voltage levels corresponding to the at least two different types of dimming signals are logically OR wired.

23. A method as recited in claim 15, wherein generating a first voltage level comprises:

if the selected one of the at least two different dimming signals comprises AC dimming:

detecting the duty cycle of the detected AC dimming signal; and averaging the detected duty cycle of the AC dimming signal to provide the first voltage level; and if the selected one of the at least two different dimming signals comprises PWM dimming, averaging the PWM dimming signal to provide the first voltage level.

24. A lighting control circuit comprising:

a dimming level detection circuit, a waveform generator; and a comparator circuit, the dimming level detection circuit configured to generate voltage level signals based on received input dimming signals of at least two types selected from among (1) phase cut AC type dimming signals, (2) voltage level type dimming signals and (3) PWM type dimming signals, the waveform generator configured to output a waveform generator periodic waveform, and the comparator circuit configured to generate a comparator waveform having (a) a comparator duty cycle based on a proportion of time during which an instantaneous voltage of the voltage level signals exceeds an instantaneous voltage level of the waveform generator periodic waveform, and (b) a frequency corresponding to a frequency of the waveform generator periodic waveform.

25. A lighting control circuit as recited in claim 24, wherein the dimming level detection circuit is configured to generate voltage level signals based on received input dimming signals of (1) phase cut AC type dimming signals, (2) voltage level type dimming signals and (3) PWM type dimming signals.

26. A lighting control circuit as recited in claim 24, wherein the dimming level detection circuit is configured to generate voltage level signals based on received input dimming signals of voltage level type dimming signals and PWM type dimming signals.

27. A lighting control circuit as recited in claim 24, wherein the dimming level detection circuit is configured to generate voltage level signals based on received input dimming signals of phase cut AC type dimming signals and PWM type dimming signals.

28. A lighting control circuit as recited in claim 24, wherein the dimming level detection circuit is configured to generate voltage level signals based on received input dimming signals of phase cut AC type dimming signals and voltage level type dimming signals.

29. A lighting control circuit as recited in claim 24, wherein the duty cycle of the comparator waveform generated by the comparator circuit is proportional to a proportion of time during which the instantaneous voltage of the voltage level signals exceeds the instantaneous voltage level of the waveform generator periodic waveform.

30. A lighting control circuit as recited in claim 24, wherein the duty cycle of the comparator waveform generated by the comparator circuit is inversely proportional to a proportion of time during which the instantaneous voltage of the voltage level signals exceeds the instantaneous voltage level of the waveform generator periodic waveform.

* * * * *

UNITED STATES PATENT AND TRADEMARK OFFICE

CERTIFICATE OF CORRECTION

PATENT NO. : 8,115,419 B2
APPLICATION NO. : 12/328115
DATED : February 14, 2012
INVENTOR(S) : Terry Given, Michael Harris and Peter Jay Myers It is certified that error appears in the above-identified patent and that said Letters Patent is hereby corrected as shown below:

Column 21

*Line 14*: please change "wavefonm" to --waveform--

Signed and Sealed this
Twelfth Day of June, 2012

David J. Kappos

David J. Kappos
*Director of the United States Patent and Trademark Office*